US007227101B2

(12) United States Patent
Harned et al.

(10) Patent No.: US 7,227,101 B2
(45) **Date of Patent: *Jun. 5, 2007**

(54) OVEN WITH AN ARTICULATING AND RETRACTABLE DOOR

(76) Inventors: Gary V. Harned, 334 S. Redlands Rd., Grand Junction, CO (US) 81503; Kim A. Williams, 334 S. Redlands Rd., Grand Junction, CO (US) 81503; Kenneth W. House, 2531 Newport Dr., Fort Collins, CO (US) 80526; Douglas P. Collins, 496 Mesa Ave., Loveland, CO (US) 80537

( * ) Notice: Subject to any disclaimer, the term of this patent is extended or adjusted under 35 U.S.C. 154(b) by 0 days.

This patent is subject to a terminal disclaimer.

(21) Appl. No.: 11/435,561

(22) Filed: May 17, 2006

(65) Prior Publication Data

US 2006/0237423 A1 Oct. 26, 2006

Related U.S. Application Data

(63) Continuation of application No. 11/080,751, filed on Mar. 15, 2005, now Pat. No. 7,064,296.

(51) Int. Cl.
*F24C 15/02* (2006.01)
*A21B 3/02* (2006.01)

(52) U.S. Cl. ..... 219/391; 219/393; 126/192

(58) Field of Classification Search ..... 126/192
See application file for complete search history.

(56) References Cited

U.S. PATENT DOCUMENTS

| | | | |
|---|---|---|---|
| 1,740,888 | A | 12/1929 | Davidson |
| 2,252,139 | A | 8/1941 | Schlacter |
| 2,953,419 | A | 9/1960 | Ingolia |
| 3,009,458 | A | 11/1961 | Pearce |
| 3,059,634 | A | 10/1962 | Brinkman |
| 4,149,518 | A | 4/1979 | Schmidt |
| 4,503,837 | A | 3/1985 | Smith |
| 5,267,597 | A | 12/1993 | Green |
| 5,375,587 | A | 12/1994 | Ward |
| 5,618,458 | A | 4/1997 | Thomas |
| 6,029,649 | A | 2/2000 | Su |
| D433,867 | S | 11/2000 | Hsu |
| 6,276,744 | B1 | 8/2001 | Huber |
| 6,727,478 | B2 | 4/2004 | Rael |
| 2003/0070789 | A1 | 4/2003 | Mueller |
| 2003/0146203 | A1 | 8/2003 | Wang |

OTHER PUBLICATIONS www.NEFF.de., Single Cirotherm Oven, Mar. 14, 2005.

*Primary Examiner*—Joseph M. Pelham
(74) *Attorney, Agent, or Firm*—Leyendecker & Lemire LLC; Kurt Leyendecker

(57) ABSTRACT

In one embodiment of the present invention, an oven having a flexible and retractable door is described. The oven door is adapted to move from a closed position wherein it effectively closes an open side of the oven box and an open position wherein the door is retracted into the body of the oven, typically below the oven box. In variations, an electric motor is provided to selectively move the oven door between the open and closed positions. In other variations, the oven includes an oven rack that is moveable between extended and retracted positions by way of a second electric motor.

20 Claims, 20 Drawing Sheets

OVEN WITH AN ARTICULATING AND RETRACTABLE DOOR

RELATED APPLICATIONS

This application has the same inventors and title as and is a Continuation of U.S. Pat. application Ser. No. 11/080,751 filed on Mar. 15, 2005, now U.S. Pat. No. 7,064,296, and accordingly, priority is claimed to the parent application, which was co-pending at the filing date of this application.

FIELD OF THE INVENTION

This invention generally relates to ovens and oven doors.

BACKGROUND

Most residences in the United States include kitchens with either one or more ovens built in to the kitchen cabinetry, or a range comprising a cook top and an oven nestled in-between sections of countertop. Almost universally, these ovens include a planar flat rectangular door that is connected to the remainder of the oven by one or more hinges mounted on one edge of the door, most often on the bottom edge.

Most typically, an oven door in its open position is horizontally disposed extending outwardly from proximate the bottom of the oven chamber. Accordingly, when the oven is opened to insert or remove food products from the oven, the door projects outwardly from the chamber into kitchen.

On ranges in particular, the oven door is elevated off of the floor only about a foot and is easily accessible by children who can be seriously burned by touching the door's upwardly facing inner surface. Further, children have caused prior art ranges to tip over onto them by climbing onto the open door of the oven. Additionally, a cook must access the oven chamber from the side rather than directly from the front of the oven. If the cook has to reach diagonally across the oven, he or she could lose balance and fall on to the hot exposed inner surface.

In galley-style kitchens, the door, which can project 20" or more outwardly when open, can effectively obstruct a cooks ability to move unhindered about the kitchen when removing or placing food products in the oven. Accordingly, the placement of an oven in a small kitchen is often dictated by space constraints rather than the optimum location relative to the other appliances and counter space for efficient food preparation.

Despite these drawbacks to the conventional oven door, very few alternative oven and oven door combinations have been proposed. U.S. Pat. No. 6,029,649 and published U.S. Patent application 2003/0146203 both teach generally arcuate rigid doors that slide over a arcuate housing between open and closed configuration, but in order for this oven and door combination to work there must be space above the top (or bottom) of the oven for the door to rotate to the open position. Further and even more disadvantageous, the configuration of the oven's exterior must be cylindrical. In order for such an oven to provide comparable space in the oven chamber as a traditional range or built in oven, the diameter of the oven must be disproportionably large. Given that space is at a premium in most residential kitchens, increasing the size of an oven is not practical. Because of these drawbacks, the ovens of the aforementioned patent and patent application relate to countertop ovens, more commonly referred to as toaster ovens, where the size of the oven chamber is not extremely critical.

Neff, a German appliance company, offers built in ovens and ranges that have a rigid door that opens in a similar manner as conventional doors but once open, the door can be slid horizontally into a chamber located beneath the oven chamber. This oven and door design ameliorates many of the problems of a conventional door when the door is slid into the associated door chamber, but given the extra step necessary to slide the door away and extra time involved in sliding the door away, it is anticipated that most cooks would not bother very often. When the door is not slid away, it presents the same space and safety issues as a conventional oven door. Further, the multifunction hinge mechanism that permits the door to be rotated open and then slid inwardly, is rather complex and more prone to malfunction than a hinge on a conventional door.

DETAILED DESCRIPTION

Figure 1:
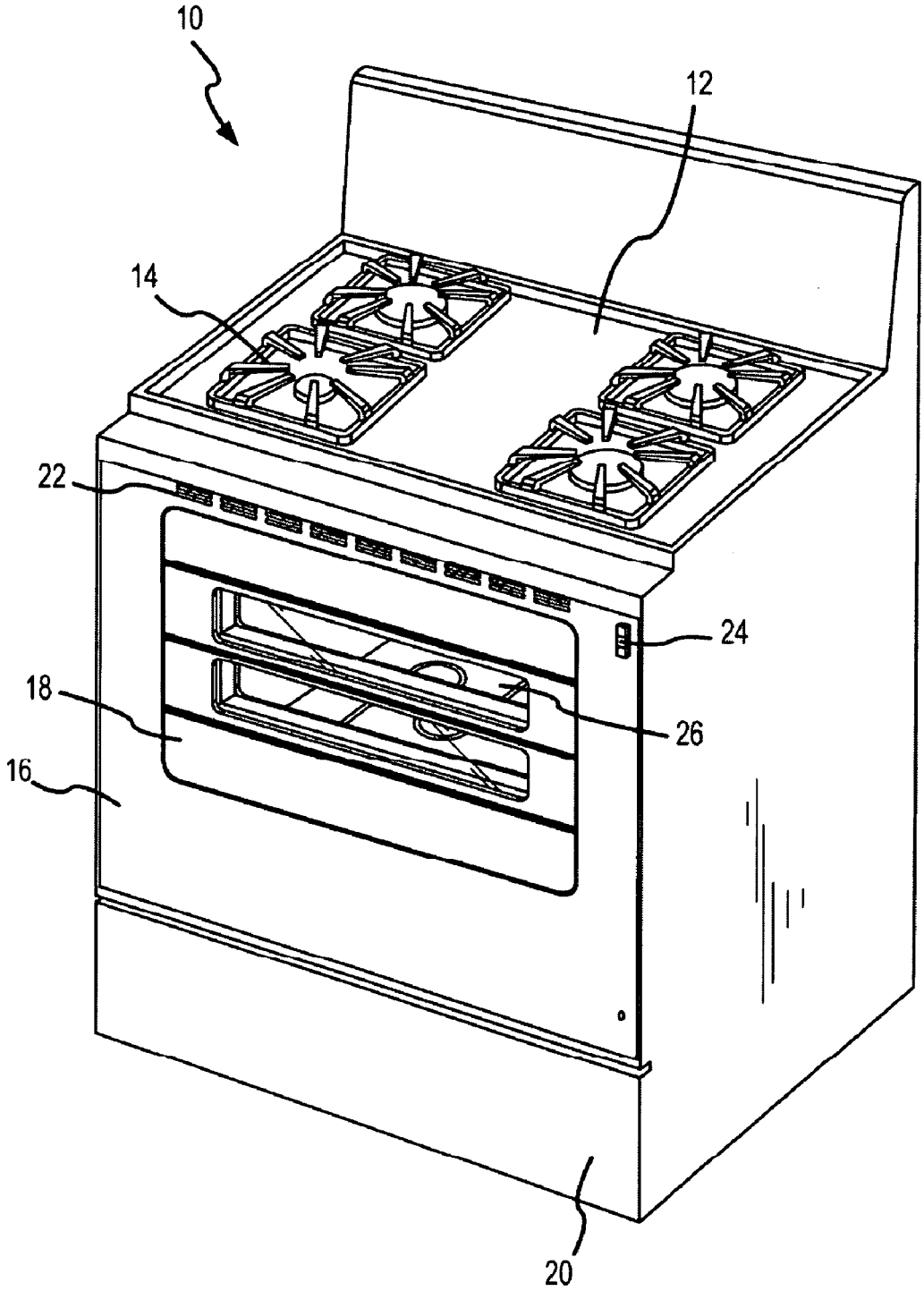
FIG. 1 is an isometric front view of a range according to an embodiment of the present invention.

One embodiment of the present invention comprises an oven including an articulated door that retracts into the space located below the oven box. Accordingly, easier and more convenient access to the oven chamber is provided. Further, the safety hazard presented by an open door extending out into the kitchen is eliminated.

The one embodiment door is preferably operated by an electric motor such that the opening and closing of the door can be facilitated by any number of suitable means, such as but not limited to (i) depressing a button, (ii) flipping a switch, (iii) activating a remote control, and (iv) providing a voice command. This can be advantageous when the a user is holding a large pan with a heavy food product in the pan as he/she can push the button with a finger without having to set the pan down on a nearby counter. Further, because the motor of the one embodiment is microprocessor controlled, the need for a separate latch to prevent the oven from being opened during a self cleaning cycle is eliminated. Instead, the controller simply disables the buttons relating to the opening and closing of the door during the cycle.

In a variation of the one embodiment, the movement of the lower oven rack is also motorized, such that the rack will move from its normal fully retracted position in the oven chamber to an extended position wherein at least half of the rack extends beyond the door opening. This variation is particularly useful for handicapped person who might have difficulty reaching in and out of a traditional oven and removing a heaving pan, such as one having a turkey in it, therefrom. The extending oven rack is also potentially useful for people with bad backs as heavy loads can be lifted more easily without straining the back, such as would be the case from bending over and reaching into an oven to remove a heavy pan.

The advantages provided, the various embodiments described above and herein are not intended to be construed as limiting. Rather, numerous variations and numerous embodiments have been contemplated that read upon the appended claims and are intended to be within the scope of the invention.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearance of the phrase "in one embodiment" in various places in the specification are all not necessarily meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The terms "switch" or "switches" as used herein to refer to any device for controlling the flow of current through an electrical trace and is not limited to any particular type of configuration of a switch including but not limited to toggle switches, buttons, rocker switches and touch sensitive switches.

A Range or Oven Incorporating an Articulating and Retractable Door

Figure 3:
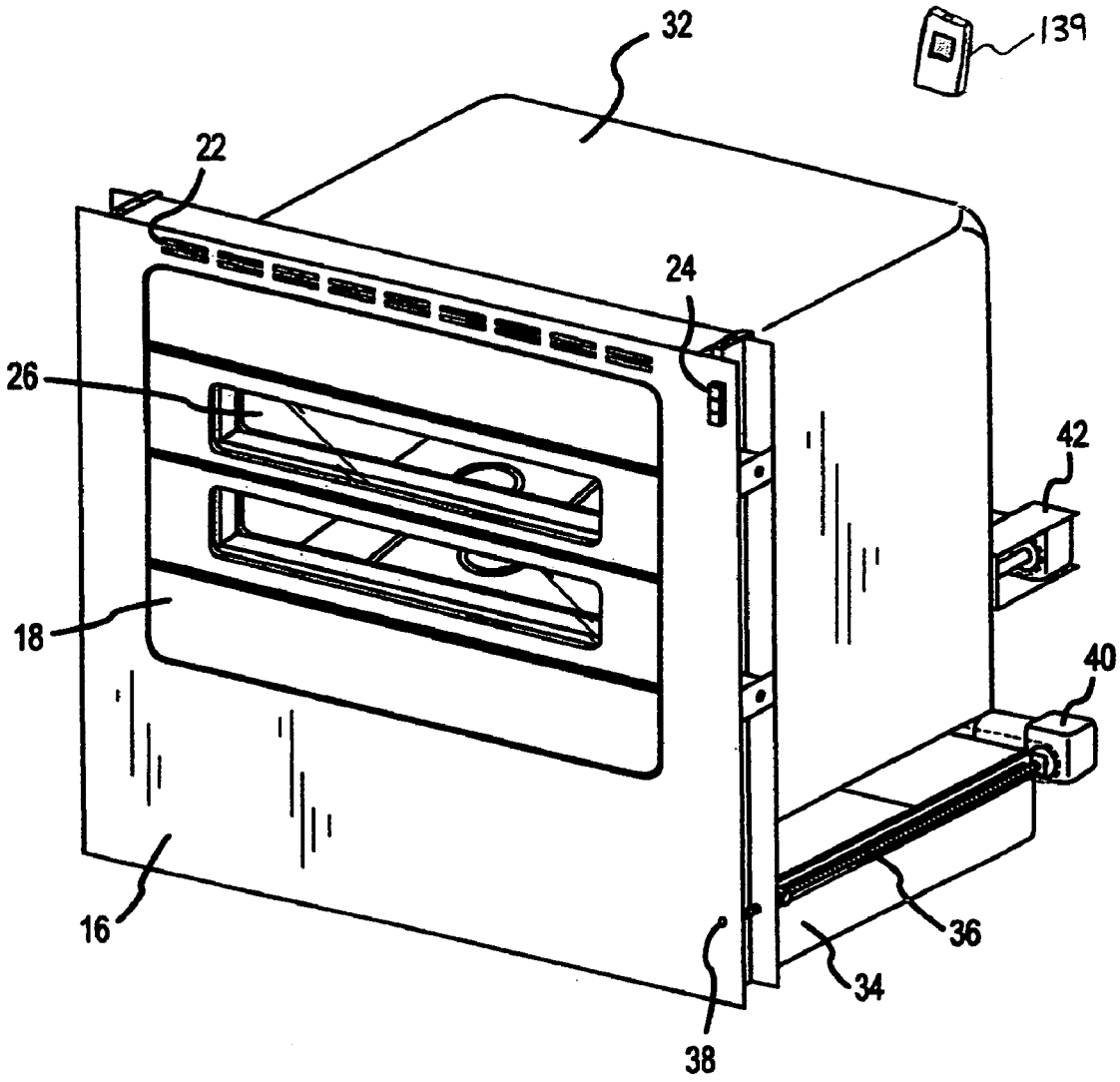
FIG. 3 is an isometric front view of an oven unit that can be utilized, for example, in either the range or in-the-wall oven of the previous Figures according to an embodiment of the present invention.
Figure 4:
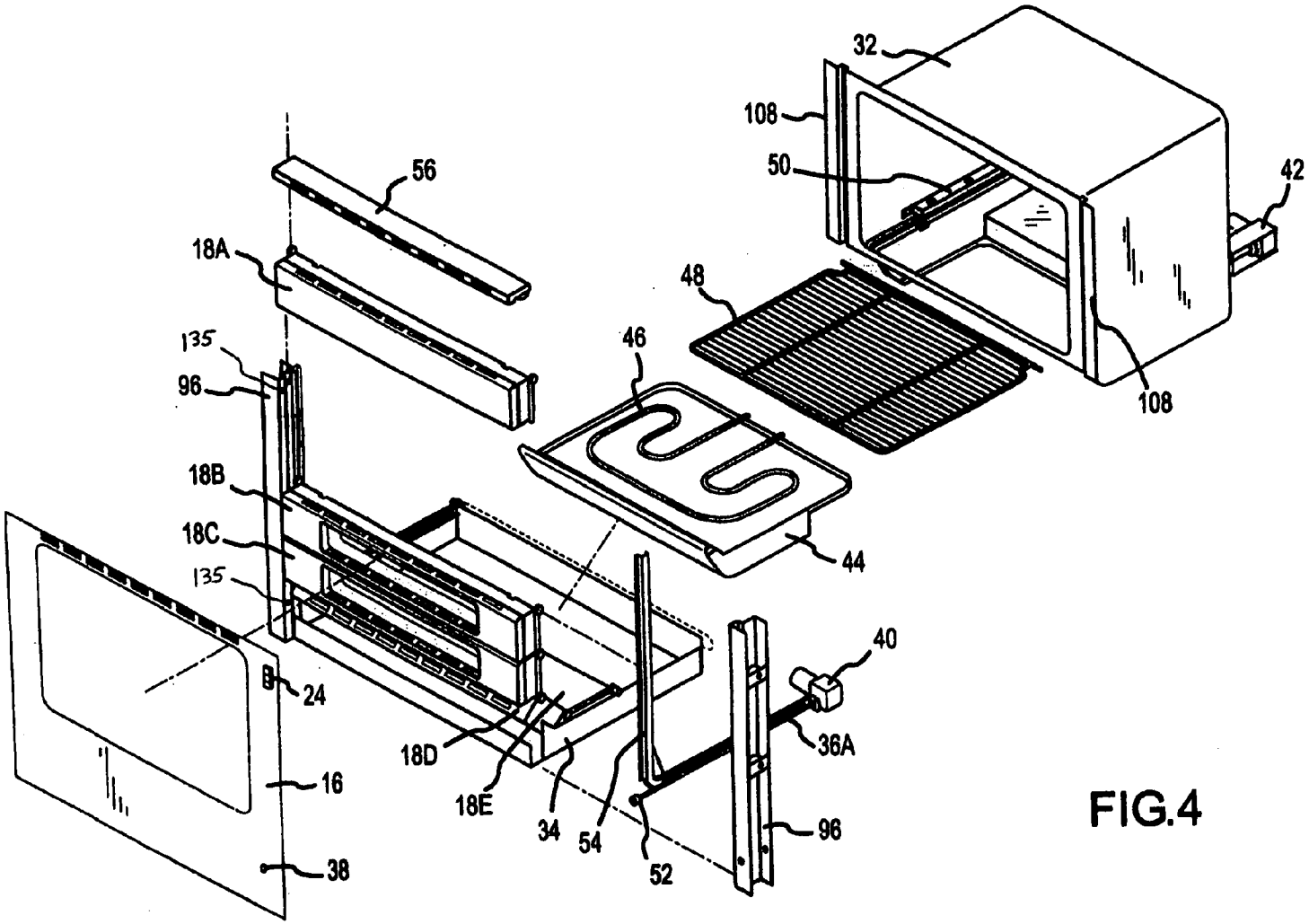
FIG. 4 is a partially exploded view of an oven unit according to an embodiment of the present invention.

Referring to FIG. 1, a range 10 according to an embodiment of the present invention is illustrated. The range typically comprises a cook top 12 having a plurality of gas or electric burners 14. Controls in the form of dials and switches (not shown) are also provided to control the operation of the cook top and an associated oven chamber 26 located below the cook top. The front 16 of the range includes a retractable door 18 comprising a plurality of pivotally connected door segments. To ensure that the door does not become hot enough to seriously burn a person, such as a child, who touches the door while the oven is in use, an air path is provided that uses convective forces to pull cooler air from beneath the door and exhaust it above the door through a plurality of vent slots 22. In other variations the air path can be ducted to the rear or side of the oven instead of out the front of the oven. As necessary, fans can be provided to assist and facilitate the flow of air. The door is opened and closed through the actuation of an electric motor. Buttons 24 or other switches are provided to permit a user to retract to close the door as desired. A remote control 139 may also be provided as shown in FIG. 3 for opening and closing the oven door. The placement of the buttons or switches can vary and are in variations coupled with an electronic control circuit 137 (or control system as shown for instance in FIG. 15) that monitors the opening and closing of the door through strategically placed infrared and other sensors 135 (as shown in FIG. 4). In certain variations, a drawer 20 is provided below the oven chamber in which pots and pans can be stored.

Figure 2:
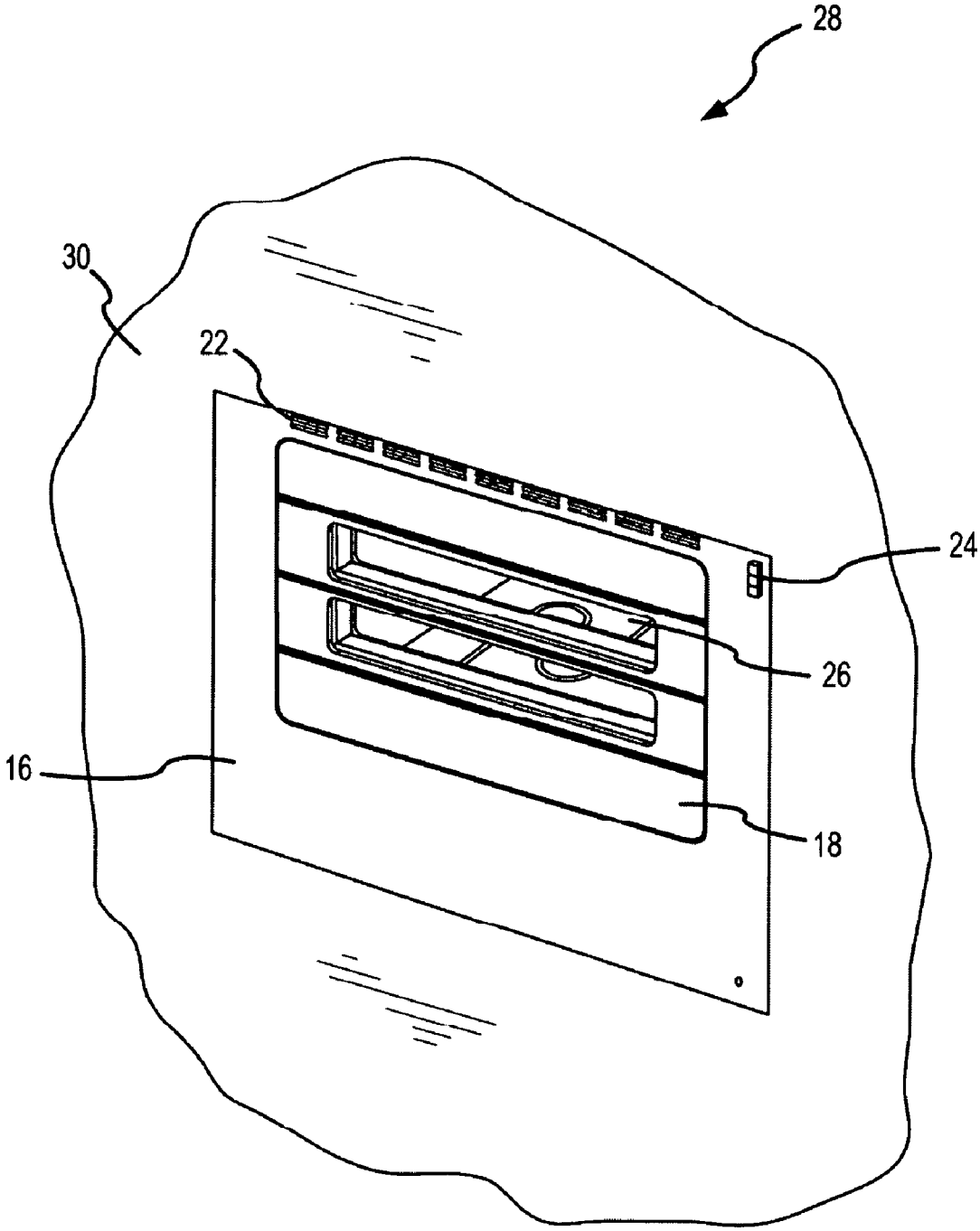
FIG. 2 is an isometric front view of an in-the-wall oven according to an embodiment of the present invention.

In another embodiment of the present invention is illustrated in FIGS. 2 wherein the oven 28 is not coupled with a cook top but is integrated into a wall 30 in the associated kitchen. In variations the in-the-wall oven can comprise an oven with a single oven chamber 26 or it can comprise a double oven having two oven chambers that are typically vertically stacked relative to each other. Aside from being located in a wall, the oven is substantially similar to the oven of the range 10 having: (i) a front side 16 with a retractable door 18 comprising a plurality of door segments; (ii) vent slots 22 above the door to exhaust air that is drawn through the door to cool the exterior surfaces of the door; and (iii) switches or buttons 24 for opening and closing the door. Additionally, controls related to the operation of the oven are provided but these have been omitted from the figure for clarity.

FIG. 3 is an illustration of the in-the-wall oven embodiment 28 removed from the wall 30. It is appreciated that the illustrated structure is generally similar to that of a range 10 as well. The oven box assembly 32 that defines the top, bottom, back, left and right sides of the oven chamber 26 is shown. The box assembly can be fabricated from nested steel boxes that are separated by an air space or a high temperature insulative material. Alternatively, the box may comprise a single steel box that is covered externally with a high temperature insulative material such as fiberglass. Two electric motors 40 & 42 are illustrated. The lower motor 40, which is shown coupled to a lead screw 36A, is used for opening and closing the retractable door 18. The upper motor 42 provided in certain variations is used to extend and retract an oven rack 48 (see FIG. 4). The operation of both motors and their associated hardware is discussed below in greater detail.

FIG. 4 illustrates the oven of FIG. 3 in a partially exploded view. As shown the bottom of the box assembly 32 is open and a separate oven pan 44 or heat shield is received in the box to fully enclose the chamber 26. The removable oven pan facilitates the cleaning of the glass on the inside surfaces of the windowed door segments 18B&C once the door has been fully retracted. A bottom heating element 46 is typically provided above the oven pan and is received into a suitable receptacle (not shown) at the rear of the box assembly. In variations of the oven, an upper element (not shown) is also provided for use to broil foods. A single motorized oven rack 48 is shown that is supported by a roller assemblies 50 located on the left and right sides of the interior of the box assembly. In place of the roller assemblies support ridges of a conventional design may be integrally formed in the inner box to provide support for the rack. Additional supports and racks are typically provided although they have been omitted from the illustrations for clarity. The additional racks may be of the traditional manually operational variety or they may incorporate an automated extension and retraction mechanism using a motor similar to the mechanism discussed herein.

The actual design and configuration of the oven box assembly illustrated in FIG. 4 and other Figures is merely exemplary and may vary significantly as would be obvious to one of ordinary skill in the art of oven design with the benefit of this disclosure.

Figure 17:
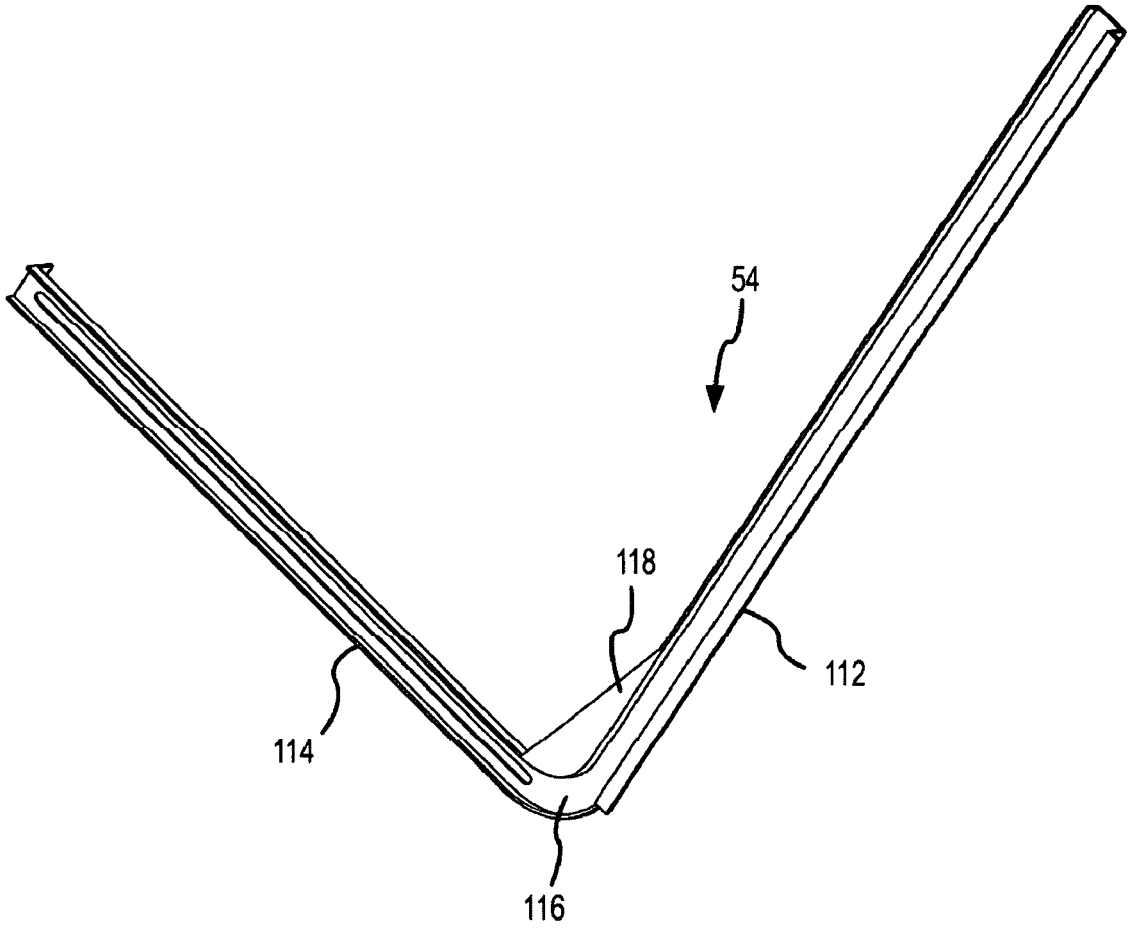
FIG. 17 is an isometric view of the oven unit's guide track according to an embodiment of the present invention.

Still referring to FIG. 4, left and right vertical door frame members 96 are provided. The frame members are coupled to an outwardly-extending flange member 108 that comprises part of the oven box by any suitable means, such as spot welding, riveting or bolting (also see FIG. 13). These members are typically stamped out of steel sheet but can also be manufactured by any suitable means using any suitable material. Functionally, the left and right frame members provide rigidity and support for the vertical portions 112 (see FIG. 17) of the left and right door track guides 54 along which segments 18A–E of the door are guided between the closed and retracted positions.

Figure 5:
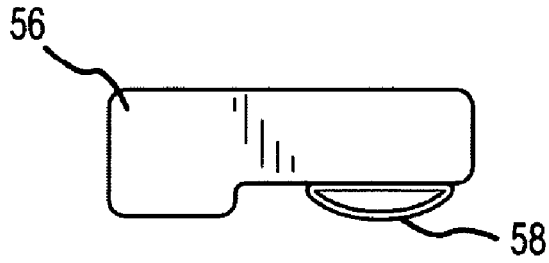
FIG. 5 is a side view of the header member of the oven unit according to an embodiment of the present invention.

Also part of the oven door frame, a header member 56 is provided that is connected to the top end of both vertical frame members. In addition to providing door frame rigidity, the header member, which is substantially hollow, receives the airflow from the air path provided in the door segments and directs it out of the vent slots 22 on the front side 16 of the oven. As discussed in greater detail below, the header also includes a door seal gasket 58 (see FIG. 5) that seals the oven chamber along the top door segment 18A. The header is typically comprised of steel and is fabricated using conventional means.

To complete the oven door frame the bottom ends of the left and right vertical frame members 96 are coupled to a base pan 34. The primary functionality of the base pan is to separate the oven unit from whatever is located below. For instance, where the oven unit is part of a range, such as shown in FIG. 1, the bottom side of the base pan forms the top side of the oven pan drawer 20. It is appreciated that in certain variations where protection of the door and its associated mechanism is not required from below the pan may be eliminated by substituting an elongated member having dimensions generally similar to the header member that spans between the bottom edges of the vertical frame members to complete the oven door frame.

Figure 10:
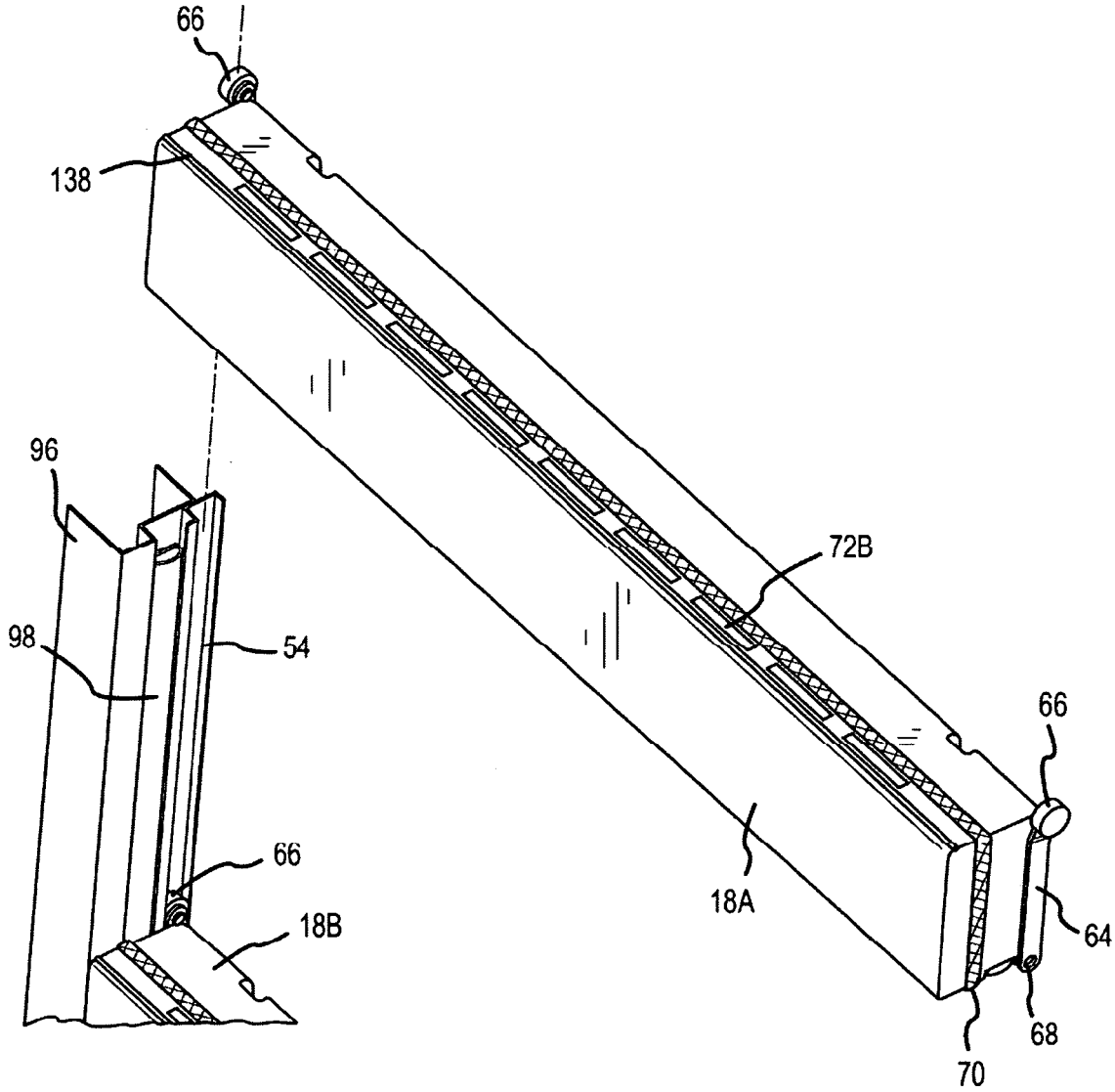
FIG. 10 is a partial isometric view illustrating a door segment and the left side of the door frame including the left guide track of the oven unit according to one embodiment of the present invention.
Figure 13:
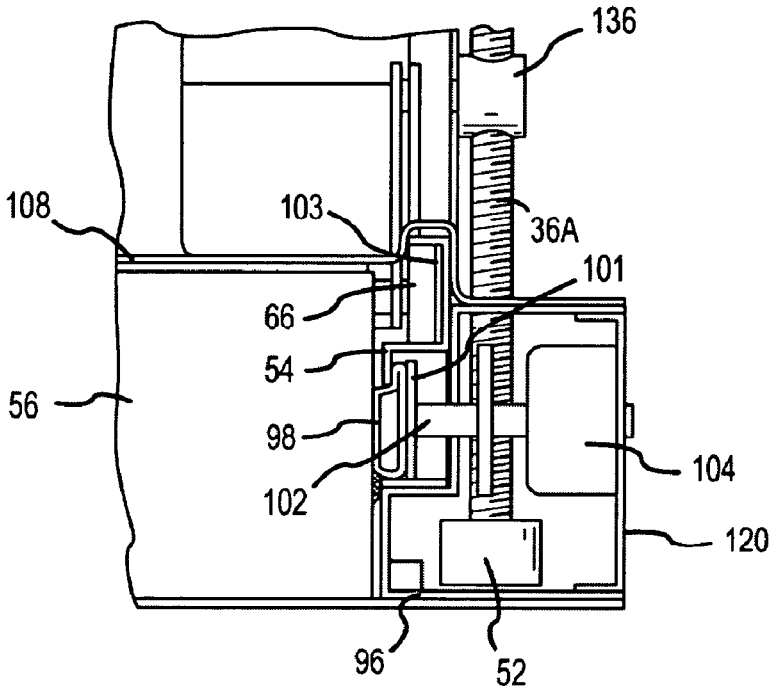
FIGS. 13 and 14 are top views taken along line 13—13 of FIG. 3 illustrating (i) a door segment interfacing with its associated guide track and (ii) a gasket for sealing against the door by way of a solenoid mechanism with FIG. 13 showing the gasket compressed against the door to form a seal and FIG. 14 showing the gasket retracted according to an embodiment of the present invention.

As indicated above, the vertical portions of the left and right track guides 54 are attached to the vertical frame members 96 as shown, for instance, in FIGS. 10 and 13. As shown in FIG. 4 and also FIG. 17, each frame member is substantially L-shaped having a substantially vertical section 112 and a substantially horizontal section 114 integrally joined together at a radiused corner 116. To further strengthen the track members, the corner includes a gusset 118 in certain variations. As shown in FIG. 13, the track guide has a C-shaped cross section adapted to receive a wheel 66 of each of the interconnected door segments 18A–E therein. Effectively, the guide tracks through the wheels support the door within the oven and facilitate movement of the door between: (i) its closed position with the top four door segments 18A–D being substantially vertically orientated (for example, see FIG. 18); and (ii) its retracted position with the bottom three door segments 18C–E being substantially horizontal and all segments being located below the oven box assembly's front opening (for example, see FIG. 15).

As illustrated in FIG. 13, the widths of the oven door segments including each segments left and right wheels 66 are slightly less than the width of the corresponding distance between the back sides of corresponding left and right guide tracks thereby leaving a small space 103 between the end of the wheel and the back side of each track guide to allow the door to thermally expand when heated without negatively impacting the door's operation.

Figure 15:
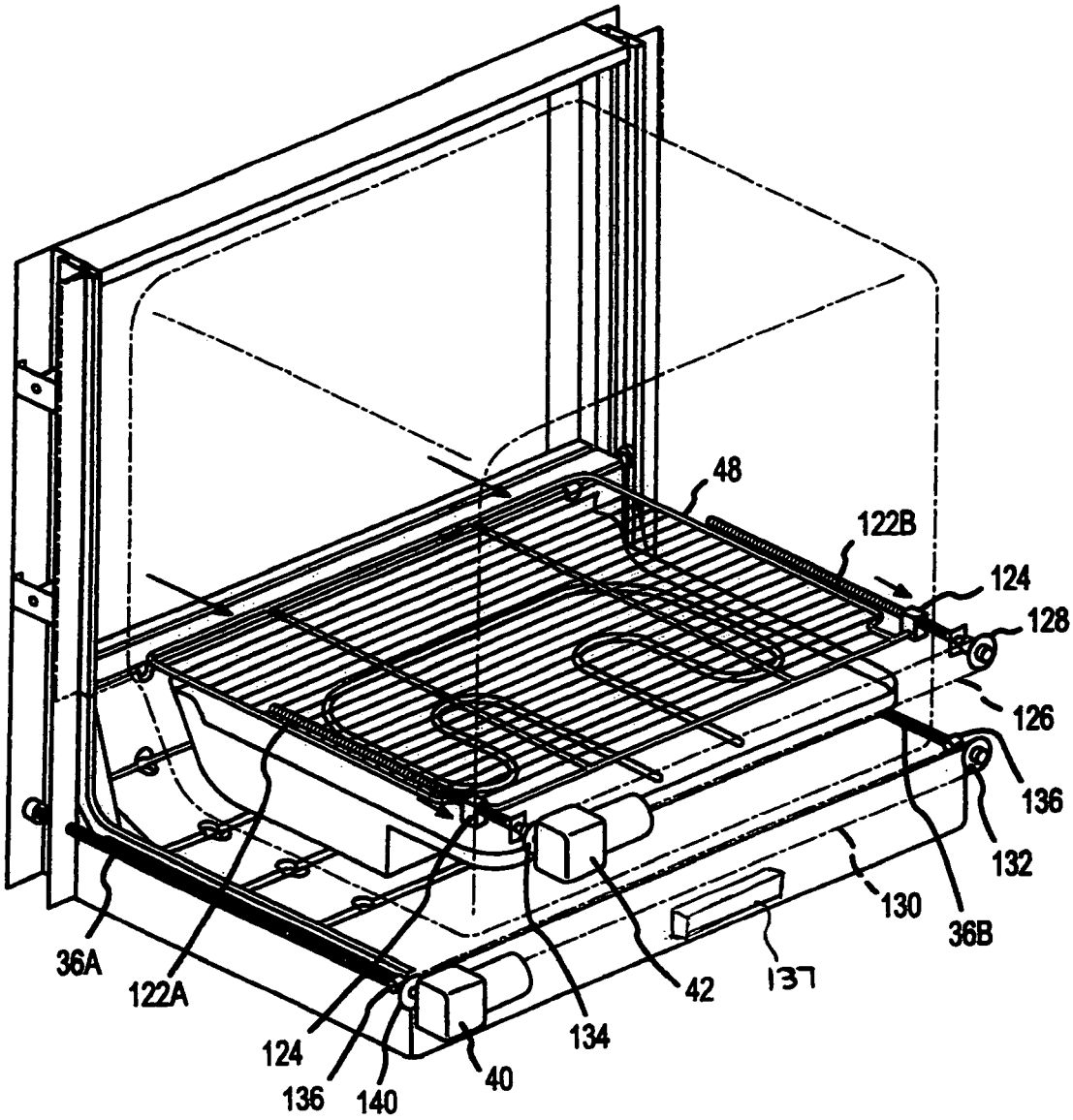
FIGS. 15 and 16 are partial isometric views of the oven unit illustrating the motor-driven extensible and retractable oven rack according to an embodiment of the present invention.
Figure 18:
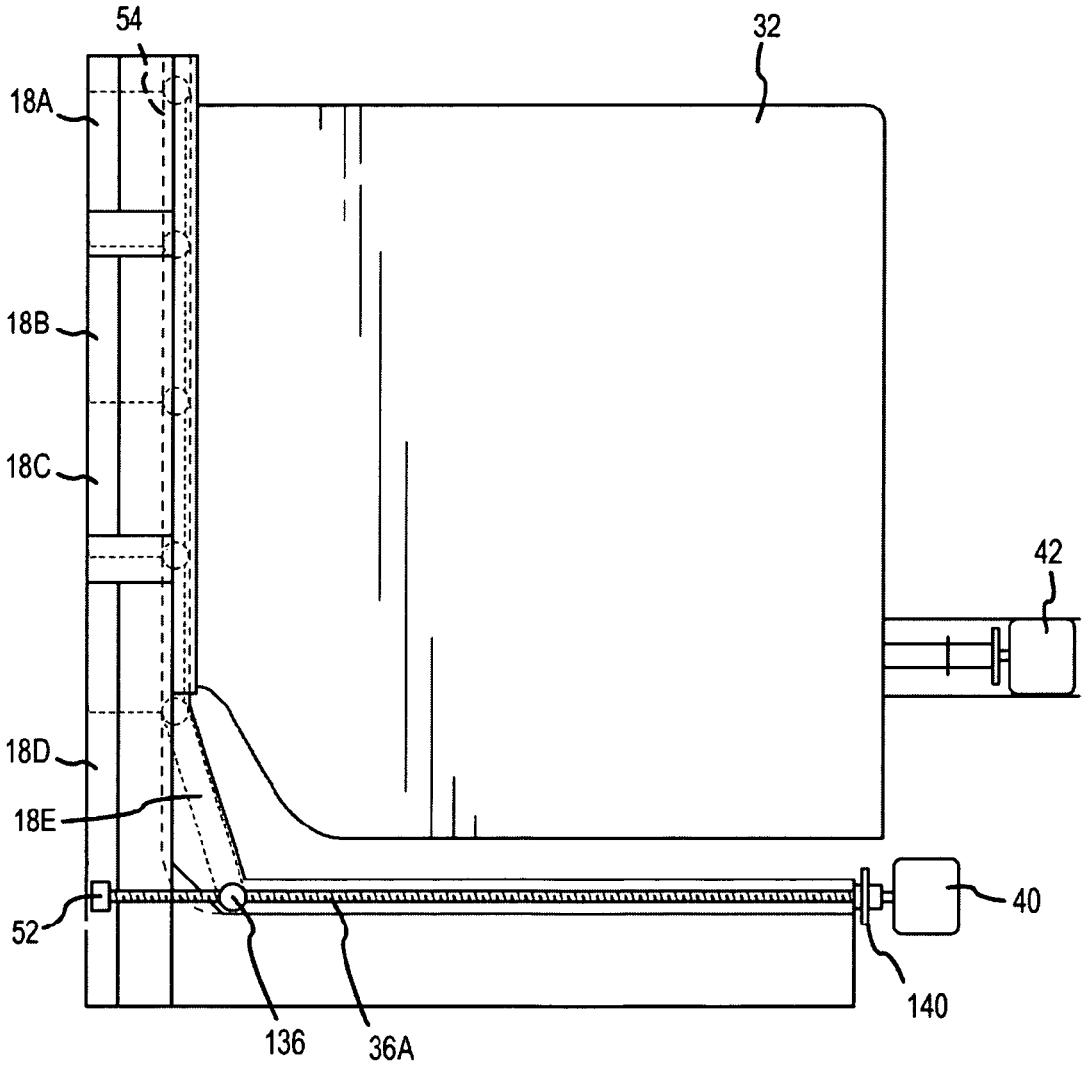
FIGS. 18, 19 & 20 are side views of the oven unit illustrating the doors opening and closing mechanism with the door in various positions between open and closed according to an embodiment of present invention.

To move the door 18 between its open and closed positions a motor driven mechanism is provided. The aforementioned lower motor 40 and associated left and right lead screws 36 A&B are activated to pull left and right nuts 136 (see FIGS. 15 & 19) that are threaded over the respective lead screws. The nuts are pivotally coupled to the left and right bottom corners of the lowest door segment 18E (see FIG. 21). The left lead screw is axially coupled with the shaft of the lower motor to turn in concert therewith by a pulley coupler 140 as can be seen in FIGS. 15 & 18. Referring primarily to FIG. 15, the pulley coupler includes a cog over which a chain 130 or tensioned belt is received. The chain extends from the right side to the left side of the oven generally behind the base pan 34 and is coupled to another pulley 132 on the right side of the oven. The right pulley is in turn coupled to the right lead screw 32B. Accordingly, when the lower motor is activated, such as by depressing the appropriate buttons 24 on the front side 16 of the oven, the lead screws rotate and cause the door 18 to be opened or closed depending on the direction of rotation of the lead screws. The lower motor may include a gear box adapted to facilitate the rotation of the lead screws at a desired rate as well as ensure sufficient torque is provided to open and close the door.

Referring to FIGS. 4 and 18, the front end of the right lead screw 36A includes a socket head 52 that is accessible through an opening 38 in the front side panel 16. Accordingly, a user can, if necessary, open the door 18 manually, such as in a situation where there is a power failure or in the very unlikely instance of a motor failure. In other variations, a battery backup power supply (not shown) may be included with the oven with a large enough capacity to permit a user to open and close the oven door a limited number of cycles in the event of a power failure.

Figure 21:
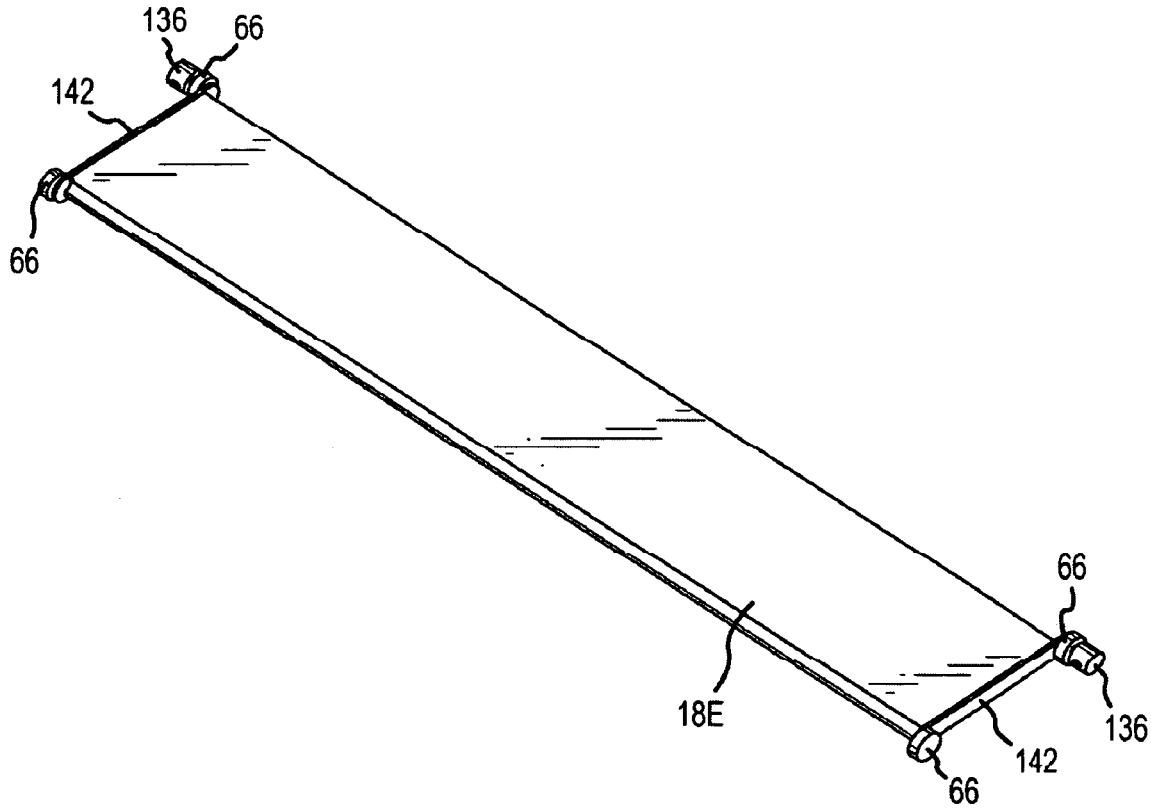
FIG. 21 is an isometric view of the bottom door segment according to an embodiment of the present invention.

The oven door 18 as shown in FIG. 4 comprises five door segments 18A–E. The top four segments 18A–D form the portion of the door that covers the oven chamber 26 when the door is closed and accordingly are insulated and adapted for exposure to the high temperatures of the oven chamber. As illustrated two segments 18B&C of the top four segments have windows permitting a user to view the food items being cooked in the oven chamber, and the other two segments 18A&D are non-windowed. In variations of the oven, any desirable combination of windowed and non-windowed segments can be specified. The lowest door segment 18E (as also shown in FIG. 21) serves to interface with the motor driven mechanism for opening and closing the door. Because this segment is never directly exposed to the oven chamber or to a user on the outside of the oven, it is typically comprised primarily of uninsulated steel plate.

Figure 6:
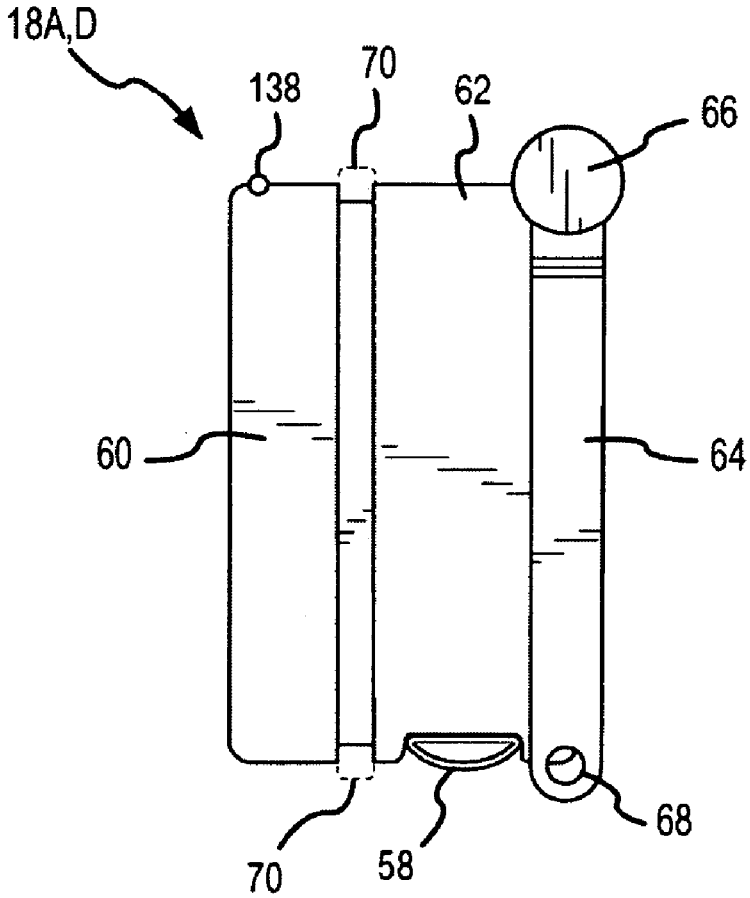
FIG. 6 is a side view of a door segment of the oven unit according to an embodiment of the present invention.
Figure 12:
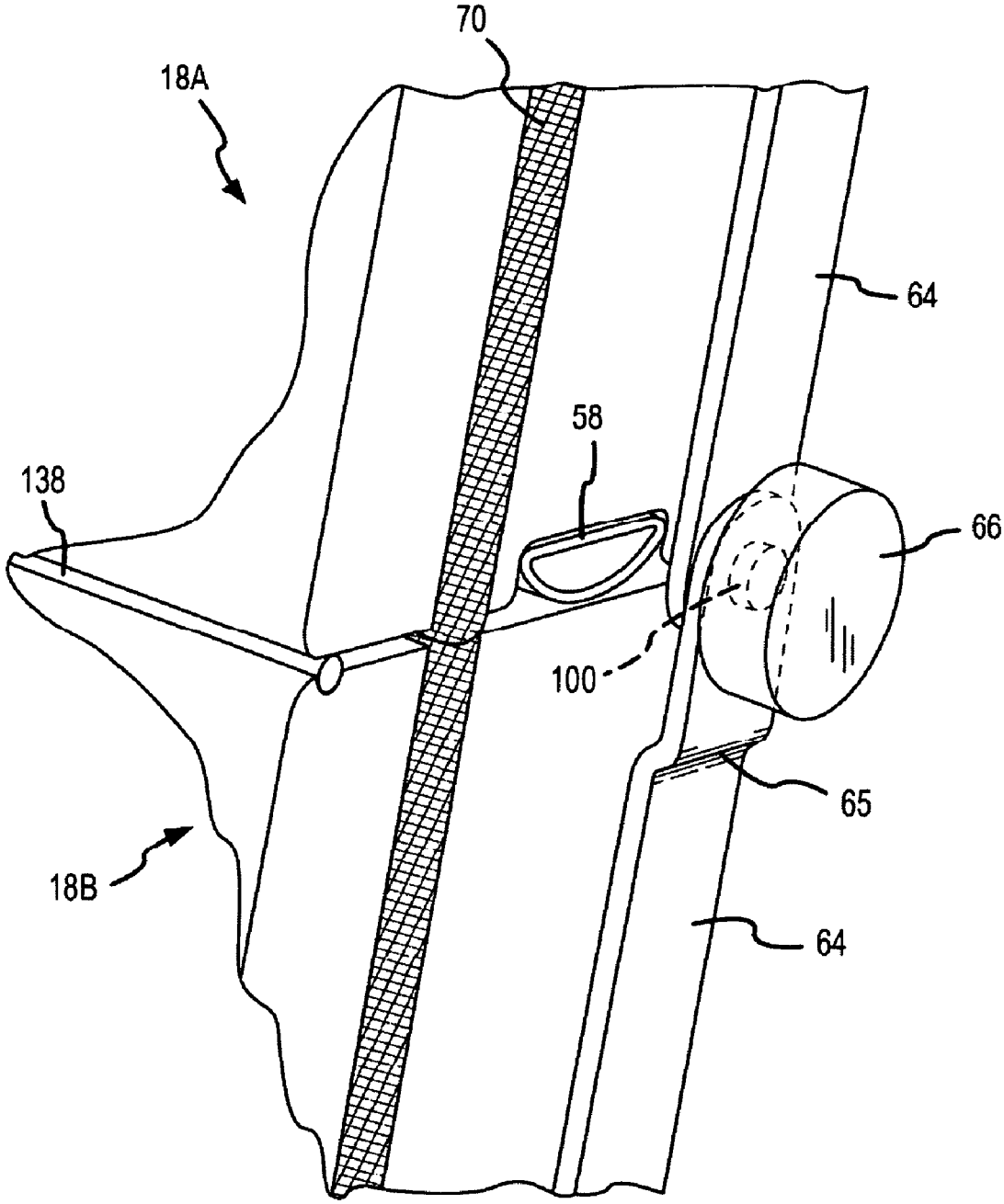
FIG. 12 is a partial close-up isometric view taken from FIG. 11 as indicated on FIG. 11 illustrating the connection between door segments.

The four upper segments 18A–D are pivotally coupled to each other through brackets 64 located on the left and rights ends of each segment proximate the segment's rear face as best shown in FIGS. 6 & 10. The bracket is attached to the door segment by any suitable means, such as but not limited to spot welding and rivets. Each bracket is generally planar but jogs outwardly from the segment proximate the top end thereof as best illustrated in FIG. 12. The jog 65 permits the bottom end of another bracket of the above adjacent door segment to be received behind the jog to facilitate the coupling of the brackets and the segments. The top and bottom ends of each bracket include holes 68 for receiving an axle 100 of an associated guide wheel 66 therein. To assemble the door segments, an upper segment is placed above a lower segment and the associated brackets and their holes are aligned. The axle of a guide wheel is placed in the aligned holes on both the left and right sides of the segments. One or more c-clips (not shown) can be used to hold the wheel and its axle in either one or both of the holes of the associated brackets. Alternatively, the axle may not be secured to either bracket but rather held in place when the wheels and door segments have been received into the left and right guide tracks as the side to side movement of the door segments is not sufficient to dislodge the axle.

Figure 22:
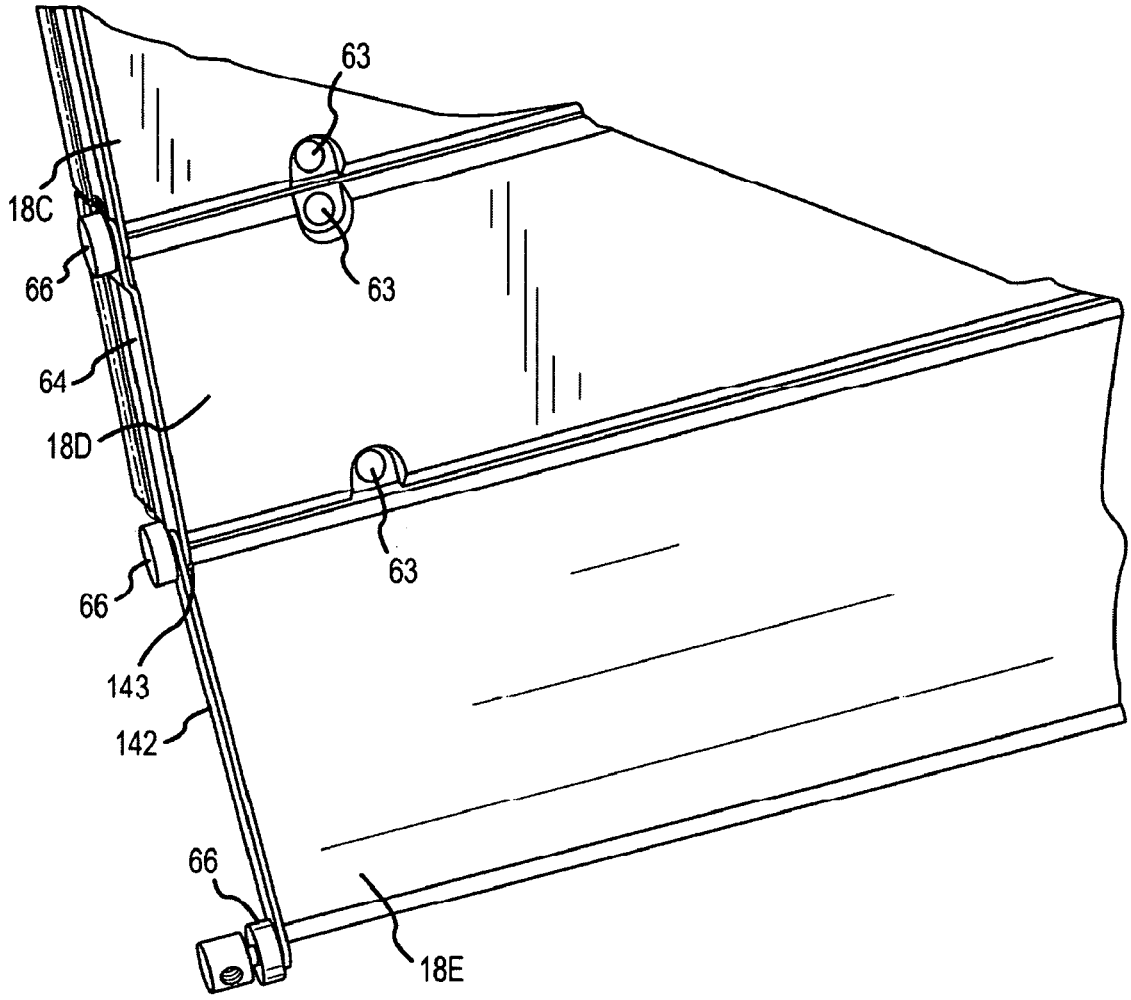
FIG. 22 is a partial isometric rear view of the lower door segments and the pivotal joint therebetween according to an embodiment of the present invention.

Referring to FIG. 21, the bracket 142 of the lowest door segment 1 8E differs slightly from the brackets used with the other door segments 18A–D. Specifically, the bracket is completely planar having no outwardly jogs at either end thereof. It is appreciated, however, that the bottom door segment 18E is slightly wider than the other segments, and accordingly, the wheels 66 fitted to both ends of the bottom door segment are fully aligned with the wheels of the upper segments having brackets with jogs. Further unlike the other segments, the bottom end of the bottom segment's bracket includes a wheel 66 attached thereto. Referencing FIG. 22, a slot is cut in bottom door segment adjacent the top of the bracket and the associated wheel so that the bottom portion of the bracket 64 of the above adjacent door segment 18D can be received therein to couple the respective door segments together. The respective threaded left or right nut 136 is pivotally attached to the bottom of the bracket 142 adjacent and coaxial with the associated bottom wheel 66. As described above, the door is opened and closed by rotating the lead screws 36A&B on which the nut is threaded to push or pull the nut, the bottom door segment 18E and consequently the entire door 18 between its open and closed positions.

Figure 7:
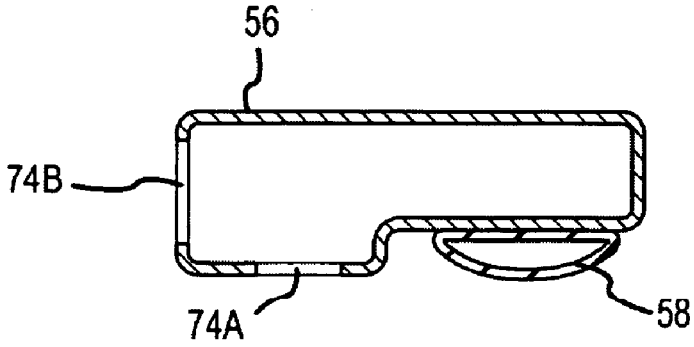
FIG. 7 is a cross sectional side view of the header member of FIG. 5 according to an embodiment of the present invention.
Figure 8:
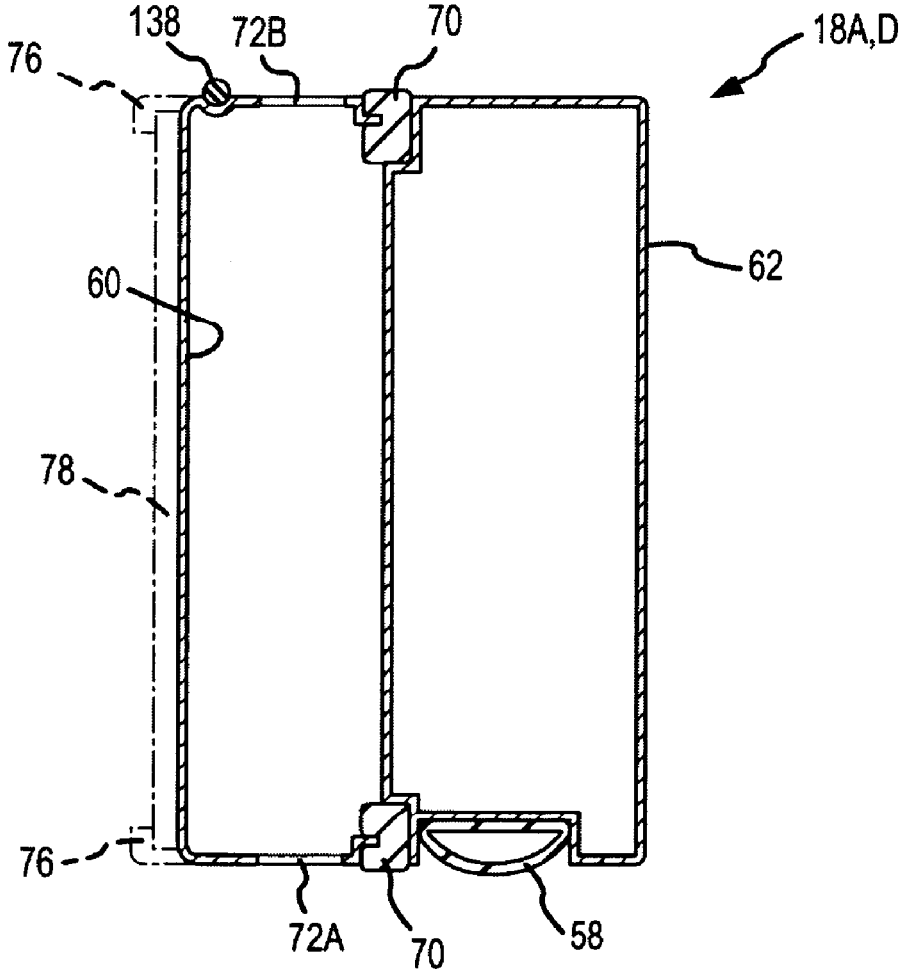
FIG. 8 is a cross sectional side view of a door segment of FIG. 6 according to an embodiment of the present invention.

Side and cross sectional views of a typical non-windowed door segment 18A, D are illustrated respectively in FIGS. 6 and 8. The typical door segment includes both a front section 60 and a rear section 62 that are each individually fabricated, typically from sheet steel stock, and later coupled together in a manner that minimizes the flow of heat from the rear section to the front section. It is to be appreciated that while these sections are typically fabricated from sheet steel, they can be fabricated from other metals and/or other processes as well. The front section forms the exterior surface of the door and encloses a convective air path wherein cooler air is funneled from vents 72A in the bottom of the lowest vertical door section 18D when the door is closed (see FIG. 23) upwardly through each section and eventually into the header member (see FIGS. 7 & 9) and exhausted out of the oven through exhaust vents 74B in the header and the vent slots 22 on the front side. Accordingly, a substantial portion of the heat from the rear section 62 is transferred to the air flow and not transferred to the front section thereby keeping the front section 60 relatively cool. The air flow through the upper door segments 18A&B and the header member 56 is illustrated by arrows 75 in FIG. 9.

To facilitate vertical air flow across the door segment 18A&D when the door 18 is closed a series of inlet vents 72A are provided on the bottom side of the front section and a corresponding series of outlet vents 72B are provided on the top side of the section as is illustrated in FIGS. 8 & 10. A small arcuate depression extends lengthwise from left to right along the top side of the front section proximate the front edge thereof. A cylindrical gasket 138 typically comprised of a high temperature elastomer, such as but not limited to Viton is received in the depression. When the door 18 is in its closed position as shown for instance in FIG. 9, the top side of a lower door segment is in contact with the bottom side of the above adjacent door segment or the header member 56 in the case of the top door segment 18A. The cylindrical gasket compresses against the adjacent bottom side, and accordingly, the gasket seals the joint between the adjacent segments to prevent a portion of the air flow from leaking out of the air path at the door segment intersection.

Referring back to FIGS. 6 & 8, the front section 60 is coupled to the rear section 62 by way of an intervening seal 70. The intervening seal is fabricated from a material having a low thermal conductivity when compared to the thermal conductivity of the steel or other material comprising the front and rear sections. The material can comprise any high temperature material low conductivity material, such as a fiberglass felt or other material commonly used in the industry. As best shown in FIG. 8, the front and rear sections are never in direct contact with each other. The front section is secured to the rear section using a small number of screws or rivets and these fasteners typically represent the only points where a metal to metal thermal transfer path is provided between the sections. Accordingly, the amount of thermal energy conductively transferred between the sections is very small helping to maintain the front section at a substantially lower temperature than the rear section.

Figure 9:
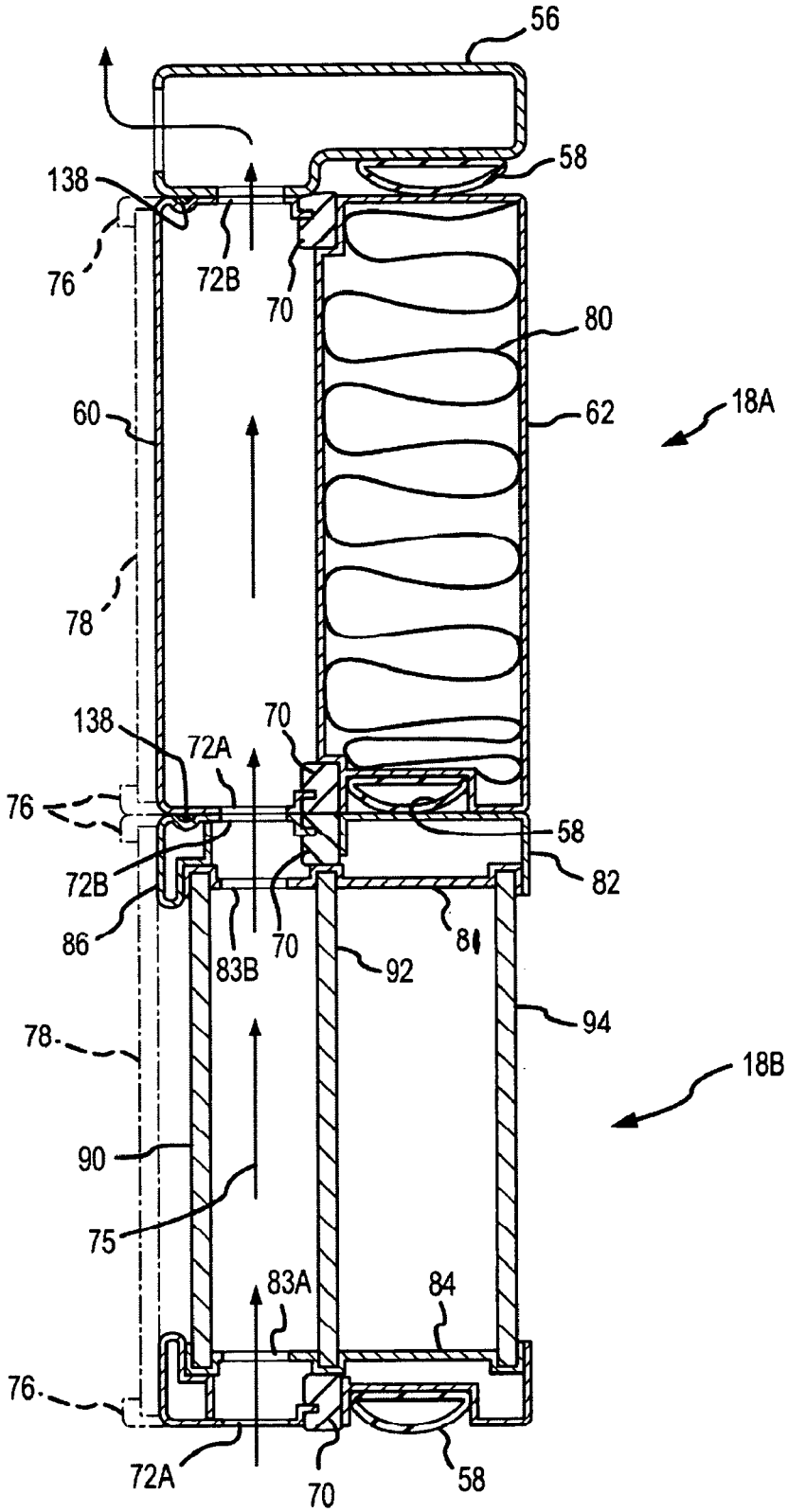
FIG. 9 is a cross sectional side view of two adjacent door segments of the oven unit according to an embodiment of the present invention: the top segment being non-windowed; and the bottom segment having windows.
Figure 23:
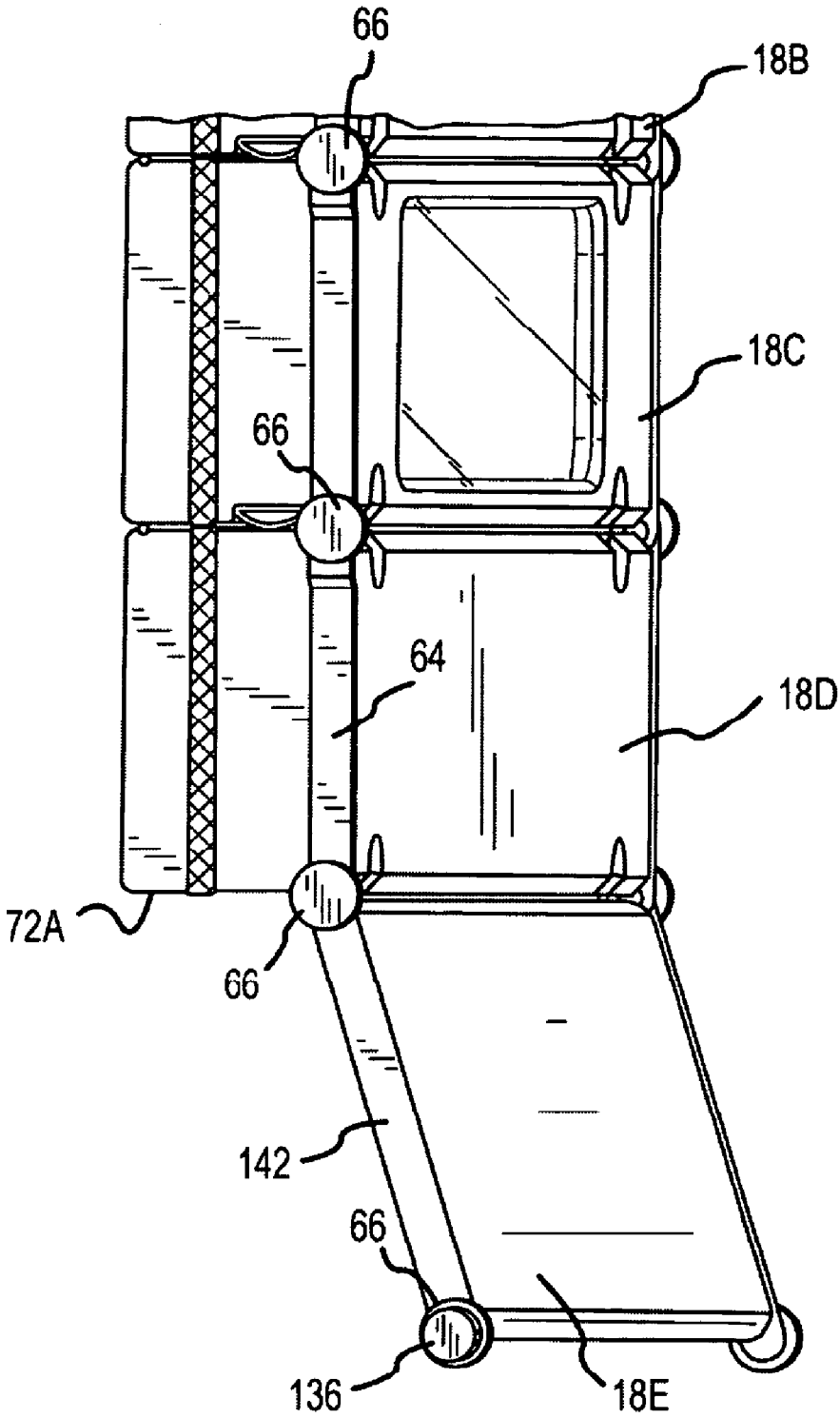
FIG. 23 is an isometric rear view of the lower door segments and the pivotal joint therebetween according to an embodiment of the present invention.

The rear section 62 is typically in the form of a box structure having a front surface that forms the back side of the air path and a rear surface in contact with the heated air of the oven chamber 26. As discussed above brackets 64 are attached to the left and right sides of the rear section proximate the rear surface. An indentation extends the entire length of the bottom surface in which a large rear primary door seal gasket 58 is received. In some of the figures, the gasket is omitted for clarity. As mentioned above, a door seal gasket is also provided on the bottom side of the header member 56. The door seal gaskets are typically comprised of a fiberglass or metal woven braid that compresses as necessary when placed in contact with the top surface of an adjacent door segment. Although the gaskets are shown as being hollow, they can also be filled with a generally compressible high temperature material, such as fiberglass or rock wool fill, such as is normally used in the industry. It is to be appreciated that the door seal gasket is provided on the bottom surfaces of the rear section 62 on door segments 18A–C. Door segment 18D does not require a door seal gasket on its rear section's bottom side as the bottom side does not butt up against the lowest door segment as shown in FIG. 23. While referencing FIG. 23, it is noted that relatively cool air is drawn into the inlet vent 72A to begin its flow along the air path defined by the front sections 60 of the top four door segment 18A–D to be eventually exhausted out of the header member 56. Although the rear section is shown as hollow in FIG. 9, it is typically filled with a suitable high temperature insulation 80, such as but not limited to fiberglass as shown in FIG. 9. The insulation helps further slow and minimize the transfer of heat towards the front section of the door segment.

Referring to FIG. 8, extensions 76 to the front section 60 are illustrated in phantom. Further, a cover plate 78 is shown that is sandwiched between the extensions and the exterior surface of the front section 60. The cover panel typically comprises a glass, plastic or metal sheet that provides the associated door segment with a finished exterior appearance that is often more aesthetically pleasing than the exterior surface of the underlying front section. The use of the extensions and the cover panel is optional and does not significantly effect the operation or functionality of the associated door segment or the door 18, although the addition of the cover panel will often have a positive effect on the external surface temperature.

FIG. 9 is a cross sectional view of the top two door segments 18A&B and the header member 56 showing the configuration of each relative to each other when the associated door 18 is in its closed position. Of particular interest is the cross sectional view of door segment 18B which comprises one of two windowed door segments 18B&C of the illustrated embodiment. The windowed segments include a window module comprising three panes 90, 92 & 94 of temperature resistant glass mounted in top and bottom formed steel or aluminum receivers 81 & 84. The top and bottom receivers include vent openings 83A&B between the front two panes 90&92 that permit the convective air flow along the air path used to help keep the front sections 60 of the door cool during oven use. Like the non-windowed door segments, the windowed door segments include front and rear sections 82&86. The front and rear sections effectively sandwich the receivers to hold the window module in place. The sections are coupled together by a small number of screws or fasteners and are effectively separated by an intervening seal 70 essentially the same as the seal used in the non-windowed door segments. The windowed door segments also include (i) a small arcuate depression extends lengthwise from left to right along the top side of the front section to receive the cylindrical gasket 138 therein, and (ii) an indentation extends the entire length of the bottom surface in which the large rear primary door seal gasket 58 is received. Additionally, the front section 86 includes inlet and exhaust ports 72A&B.

As illustrated in FIG. 9, receivers of the window module butt directly up against the front and rear sections 82&86 of the windowed door sections 18B&C thereby providing a direct metal path for heat to be conducted between the oven chamber and the exterior surface of the front section. Practically, the receivers are relatively thin and heavily perforated, limiting the amount of heat energy conducted across them; however, in variations of the illustrated windowed door segment, a gasket material having a low coefficient of thermal conductivity can be placed in an intervening relationship between the receivers and the respective front and rear sections 86&82 to reduce the conduction of heat by way of the receivers.

Like the non-windowed door segments, variations of the windowed door segments can include extensions 76 on the front sections that permit a cover panel 78 to be placed over the exterior surface of the front section 86. In the windowed door sections, the cover panel is usually comprised of glass so not to hinder the ability of a user to view the interior of the oven chamber through the window module.

As can be appreciated, to maximize the efficiency, effectiveness and safety of an oven, the interface between the oven door 18 and the oven box 32 must be sufficiently sealed to prevent the heated air within the oven chamber from leaking out of the oven chamber 26. As described above, the interface between each of the segments 18A–D is sealed by the primary door seal gaskets 58 located between the interface of each of the top four door segments and between the header member 56 and the top door segment 18A as shown for instance in FIG. 9.

Figure 11:
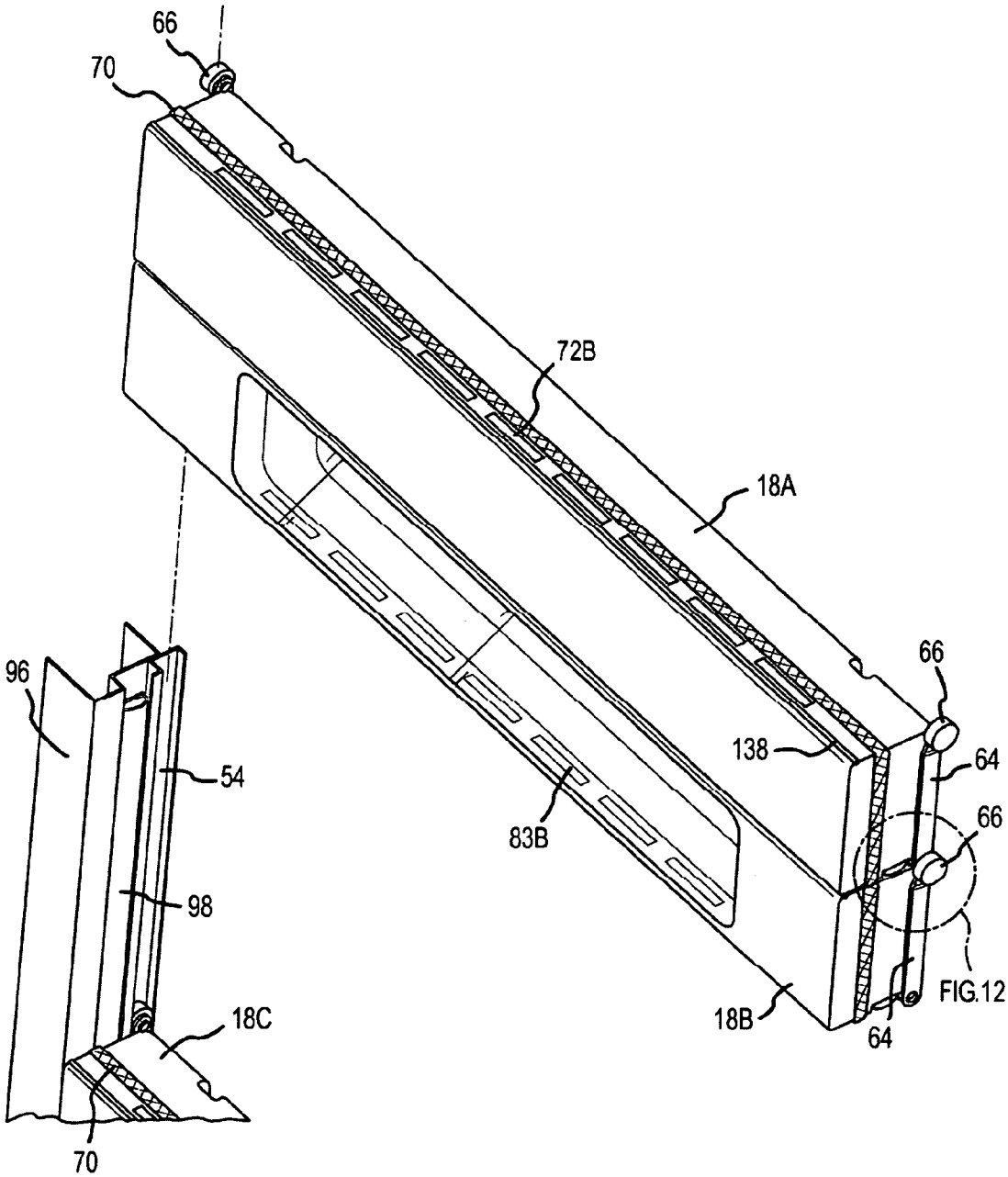
FIG. 11 is a similar partial isometric view as FIG. 10 further illustrating a windowed door segment coupled to a non-windowed segment.
Figure 16:
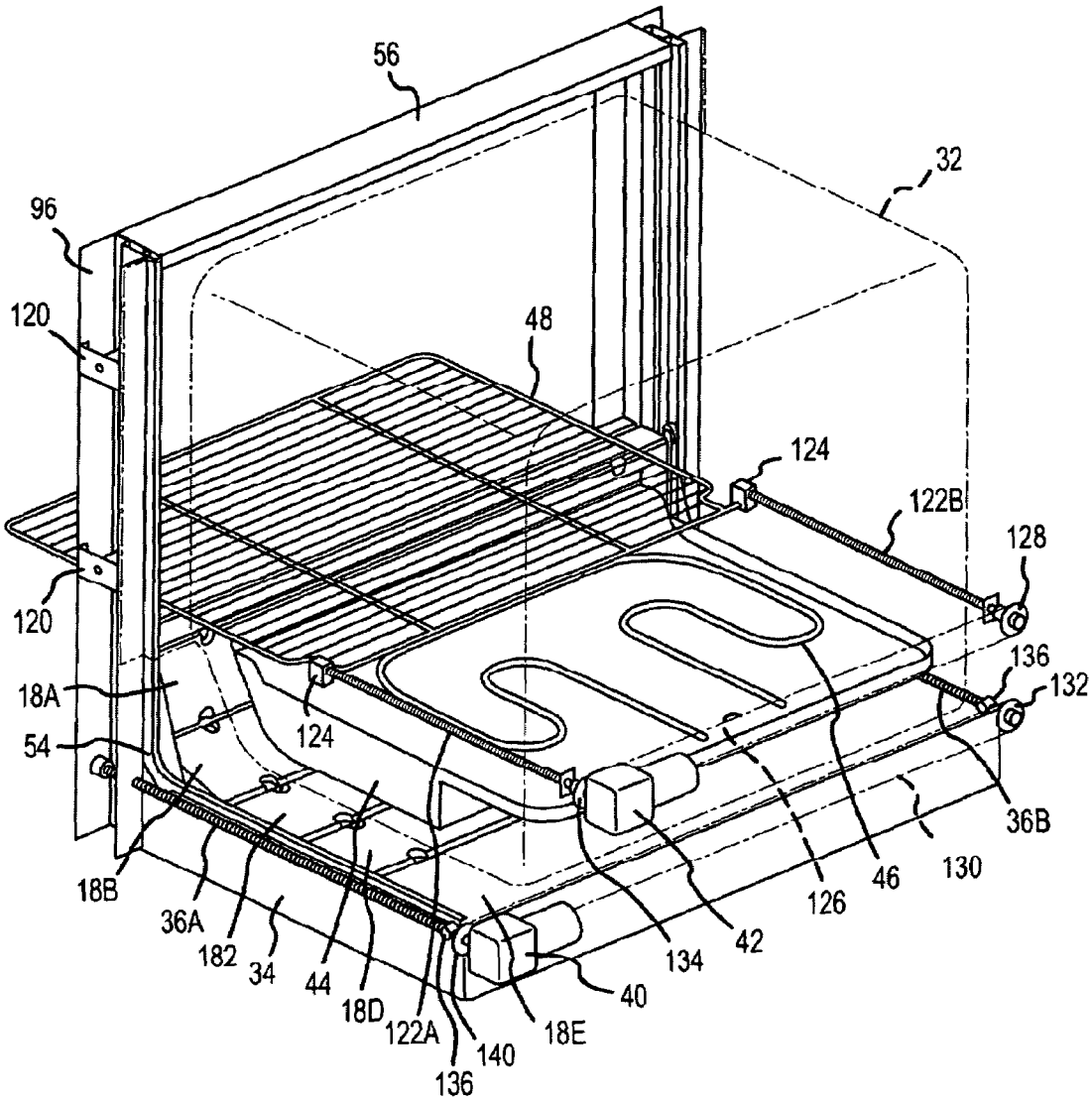

Vertically-orientated side door seals 98 are located in a vertical recess in each vertical frame member 96 for sealing the sides of the door 18 as shown in FIGS. 10 & 11. Specifically, the side door seals abut the side surfaces of the rear sections 62&82 of the top four door segments 18A–D as specifically illustrated in FIG. 13. The side door seals typically comprise similar materials and construction as the primary door seals 58. The side door seals are mounted to elongated vertically orientated plates 101. The plates are in turn mounted to the shafts 102 of two solenoids 104. The solenoids are mounted to the vertical frame members at vertically spaced locations as shown in FIG. 16 using solenoid brackets 120. The solenoids are electrically coupled to the control system of the oven and are activated when the door is put in motion to open or close the door. In its unactivated state, the shafts of the solenoids are fully extended biasing the associated side door seals against the sides of the door and a lip on the vertical portion 112 of the guide track 54 to effectively seal the vertical sides of the oven chamber. Referencing FIG. 13, the interface of the seal with the sides of the door segments prevents hot oven chamber air from escaping from the chamber between the sides of the door and the vertical frame members 96. However, if the side door seals 98 were sealed against the sides of the door segments only, hot air could escape through the openings in the vertical frame members 96 through which that the solenoid shafts pass. By providing the lip on the guide track and having a portion of the side door seal of each side seal against the lip of the respective track guide, hot air and gasses from the oven chamber are inhibited from leaking out of the solenoid shaft openings.

Figure 14:
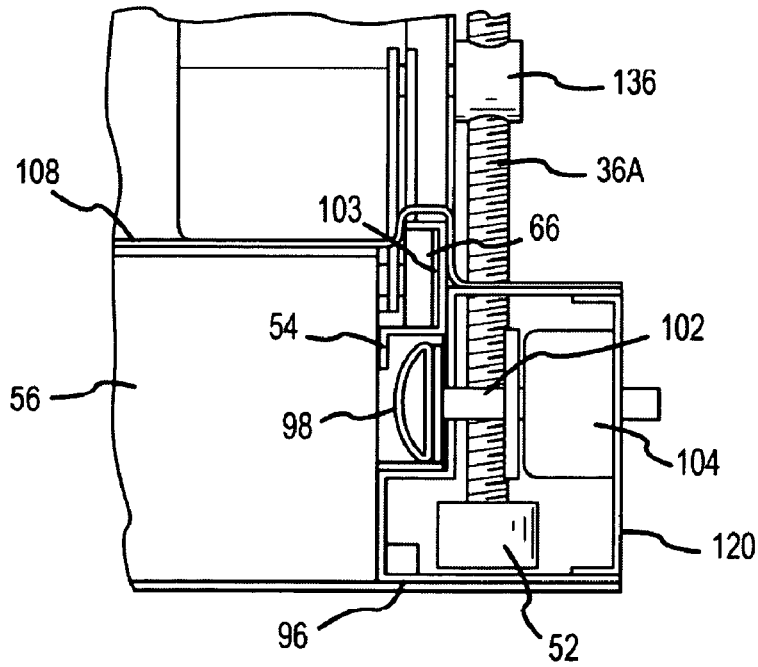

When a user activates the lower motor 40 to open or close the door 18, the control system sends current to the solenoids 104 causing them to retract as shown in FIG. 14, thereby pulling the respective side door seals 98 away from the sides of the door segments 18A–D. Accordingly, the door can be opened or closed without undue friction from the side door seals. When the door has finished moving and current flow to the lower motor is stopped, flow of current to the solenoids is also terminated causing the seals to return to their unactivated positions. Of note, in oven embodiments not having a battery power backup, the side seals will not retract when a user opens the door by turning the right lead screw 36A by way of the screw's socket head 52. While this will make the door to be more difficult to open, the amount of friction imparted by the seals is not sufficient enough to make the task unreasonably difficult.

Traditionally, oven chambers are not fully sealed along the bottom edge of an oven door. This permits fresh air to enter the oven chamber during its use. Further, omitting the bottom seal does not significantly effect the efficiency of a typical oven as hot air does not easily flow downwardly out of the doors bottom primarily because hot air rises and is also blocked by the denser cooler air located below the oven door under and in front of the oven chamber 26. In variations of the oven, the bottom edge of the interface between the oven door 18 and the oven chamber can be fully or partially sealed. For instance, a forward facing high temperature gasket (not shown) can attached to the oven box assembly proximate the bottom edge of the oven chamber's opening such that it provides a light bias against door segment 18D when the door is fully closed.

The operation of the door 18 and its associated motor driven mechanism can be described with reference to FIG. 18-20. Initially, when the oven door is closed, the top side of the top door segment 18A is in direct contact with the header member 56 as also illustrated in FIG. 9. The upper four door segments 18A–D are all vertically aligned with each other and as such sealed at their respective interfaces by both the cylindrical gasket 138 and the primary seal gasket 58. Additionally, the interface between the sides of the door segments and the oven chamber opening are also sealed by the side door seals 98. The bottom door segment 18E is canted rearwardly at an acute angle off of vertical and through its pivotal connection with the adjacent door segment 18D, it holds the other segments of the door in the closed position.

Figure 19:
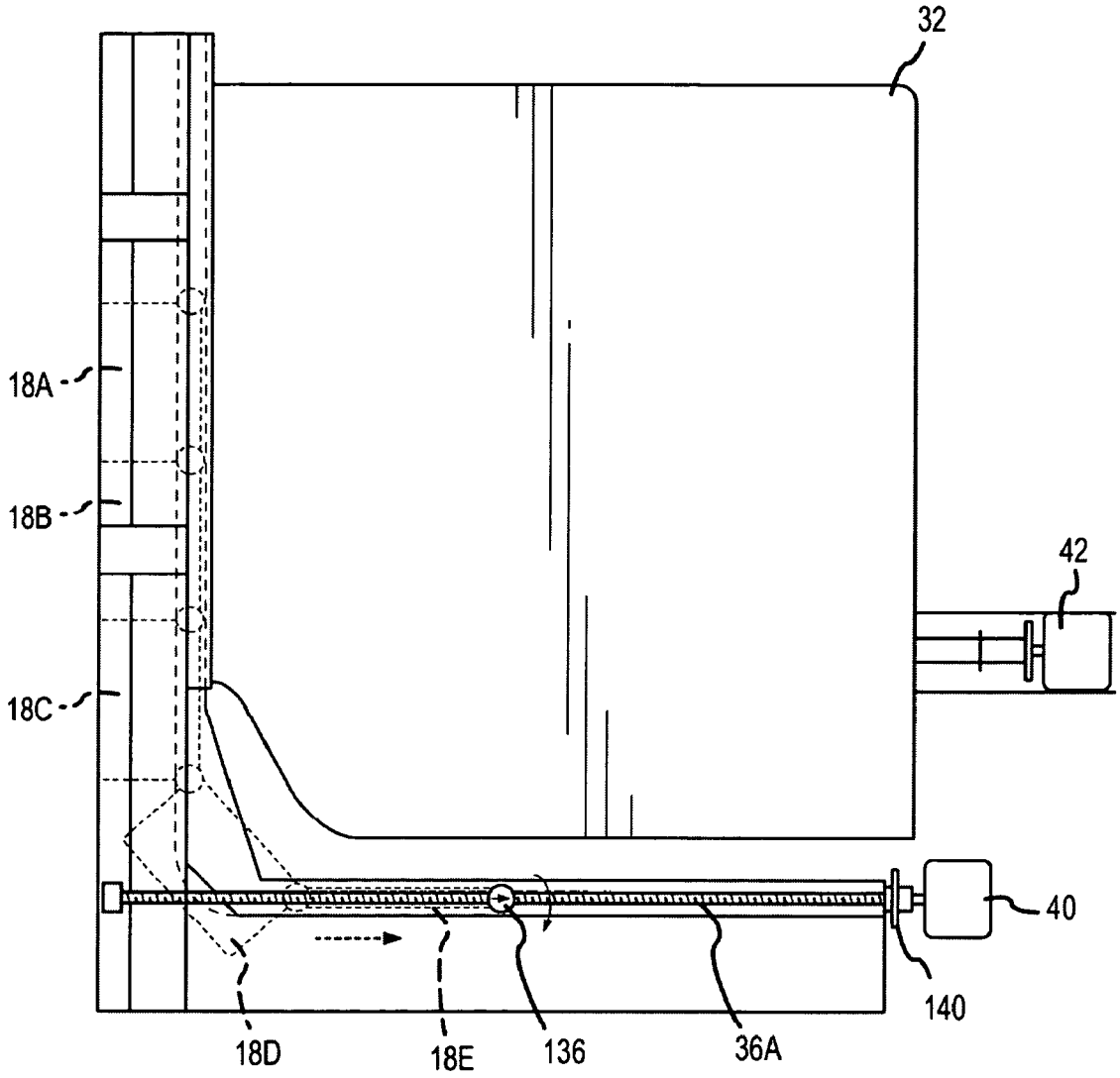
Figure 20:
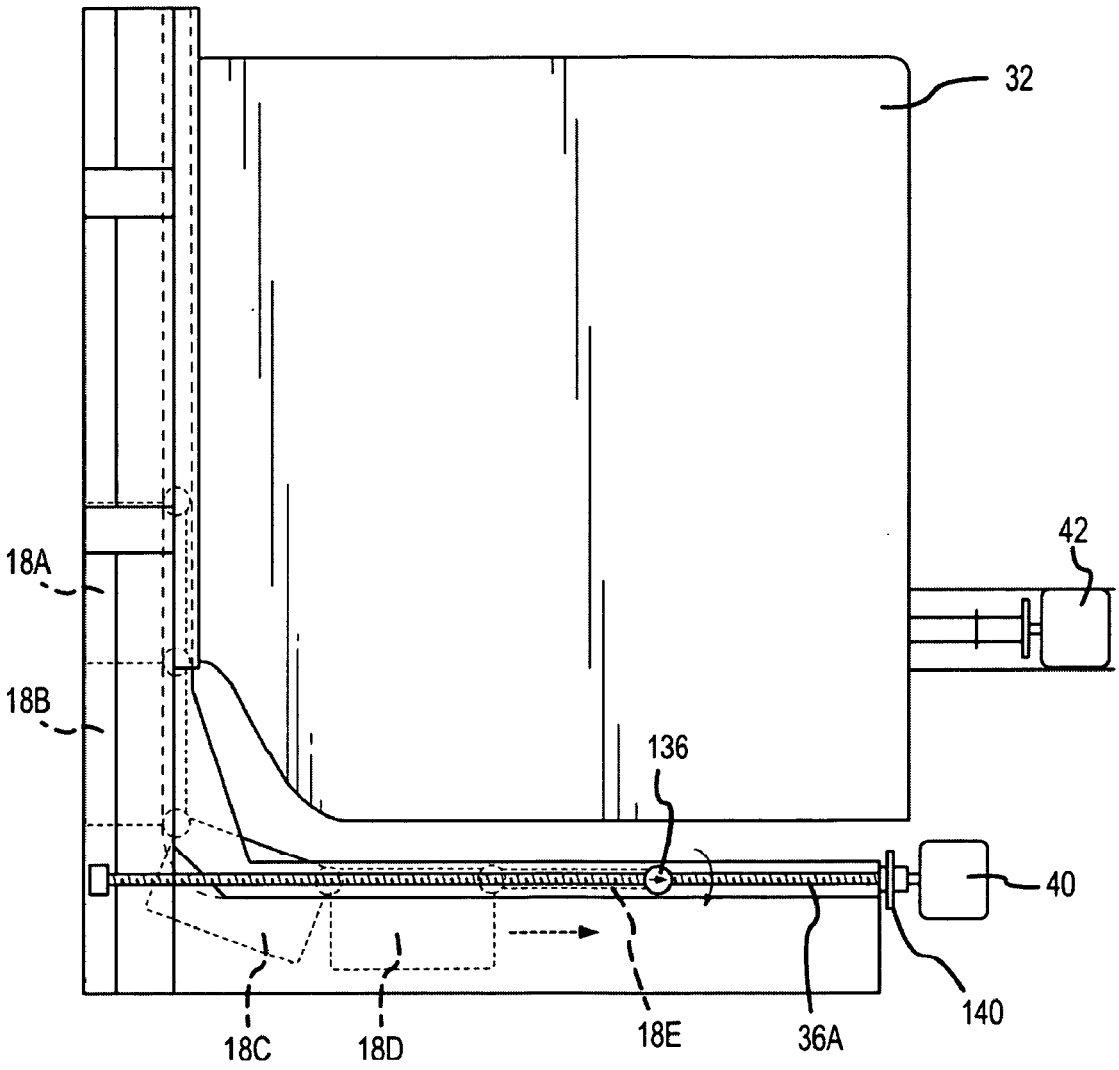

To facilitate the opening of the door as shown in FIGS. 19 & 20, a user activates the lower motor by depressing the appropriate button 24 on the front of the oven or on an oven control panel (or uses an other means such as remote control or voice activation). In preferred variations, depressing the appropriate button causes a control system to activate and control the operation of the lower motor as well as the solenoids 104 associated with the side door gaskets 98. The control system may also be interfaced with one or more sensors (not shown), such as infrared sensors, located along the door's path of travel. The sensors can be used to indicate to the controller when the door is open or closed as well as whether anything is obstructing the door that might prevent it from being closed. Other sensors can be provided to verify that the oven racks are properly retracted and fully contained within the oven chamber. One or more load sensors coupled with the motor 40 may also be utilized to help determine whether the door is fully opened or closed, or that something is hindering the normal operation of the door mechanism. Based on the information from the sensors and the control system's knowledge concerning the state of the oven, it will provide power to the lower motor to open or close the door. For instance, when the oven is in a self-cleaning cycle wherein the temperature in the oven chamber is extremely high, the controller may deactivate the buttons or other controls that permit a user to open the door. Advantageously, embodiments and variations of the oven need not utilize a self cleaning door locking mechanism found on prior art self cleaning ovens. In some variations, the motor may also have applied a holding current applied to it, which will also make it difficult or impossible to manually turn the crank socket 52 while the oven is in the self cleaning mode.

Although three buttons 24 are illustrated concerning the user's control of the oven door, in variations more or less buttons can be used or other types of switches can be substituted for the buttons. Further, in variations using a control system, the buttons can serve more than a single function depending on one or both of the state of the oven and the location of the door (i.e. whether the door is open or closed). For instance, one button can be an automatic open button wherein the door fully retracts when pushed once only momentarily. Another buttons may need to be held in to cause the door to open or close. Another button may be an emergency stop button. The operational actual configuration of the buttons can vary significantly as would be obvious to one of ordinary skill in the art given the benefit of this disclosure.

Once the appropriate button 24 or other input has been activated, the control system provides current to the lower motor 40 causing its shaft to rotate in the clockwise direction. The motor through the pulley coupler 140 causes the right lead screw 36A to rotate in the same direction. Further, the pulley coupler pulls the drive chain 130 or belt, which in turn rotates the left lead screw 36B clockwise through the left pulley 132. The lead screw in turn pulls the respective left and right nuts 136 which pull the bottom door segment 18E rearwardly along the horizontal portion 114 of the guide track 54. As indicated FIGS. 19 and 20, the bottom door segment pulls the other segments 18A–D downwardly along the guide track, around the radiused intersection 116 of the vertical and horizontal portions of the guide track, and for the lower segments rearwardly to expose the oven chamber 26 opening and permit a user access thereto.

When the appropriate button is pushed to close the door, the control system provides a reverse current to the lower motor 40 causing its shaft and the associated lead screws 36A&B to rotate in a counterclockwise direction. Accordingly, the nuts 136 move towards the front of the oven pushing the door segments 18A–E along the guide track back into the fully closed position in front of and sealing the oven chamber opening.

As indicated above, certain variations of the oven include one or more motor driven oven racks. A single motor driven oven rack 48 and its associated extension and retraction mechanism are illustrated primarily in FIGS. 15&16. The oven rack mechanism is similar to the mechanism used to open and close the oven door 18 comprising the upper motor 42 coupled with left and right lead screws 122A&B by a pulley coupler 134 and a pulley 128 respectively connected by an intervening drive chain 126. Left and right threaded blocks 124 are typically removably secured to the associated oven rack 48 proximate its back end and threaded through the respective left and right lead screws. As shown in FIG. 4, the oven rack is supported by a bracket 50 mounted to the side of the oven chamber that include a plurality of rollers to minimize the friction related to moving the rack, especially when loaded, in and out of the oven chamber while providing adequate support for the rack. In other variations and embodiments, the supports for the oven rack can vary substantially as would be obvious to one of ordinary skill in the art with the benefit of this disclosure.

Operationally, a user activates the appropriate switch or button (not shown) to extend the rack 48 partially from the oven as indicated in FIG. 16 after the oven door 18 has been opened to provide access to any food stuffs on the rack without having to reach into a heated oven chamber 26. In the variations having a control system, the control system may disable the operation of the oven rack while the oven door is closed. In other variations, the controller may automatically extend the rack after the oven door has fully retracted. To extend the rack, current is provided to the upper motor 42 to cause the motor's shaft and the lead screws 122A&B to rotate in a counterclockwise direction thereby pushing the threaded blocks 124 and the attached oven rack outwardly. To retract the rack, current in the opposite direction is provided to the motor to cause its shaft and the lead screws to rotate in a clockwise direction thereby pulling the rack into the oven chamber as indicated in FIG. 15.

Other Embodiments and other Variations

The various preferred embodiments and variations thereof illustrated in the accompanying figures and/or described above are merely exemplary and are not intended to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the embodiment described herein relates to a motor controlled articulating door comprising a plurality of segments. In variations and alternative embodiments, the door may not comprise segments that are mechanically attached to each other. Rather the door may comprise one or more layers of a flexible sheet material, such as a corrugated stainless steel sheet stock that flexes at the associated folds in the material to retract to a position under, over or to the side of the oven chamber opening. In one alternative embodiment, the door comprises two sheets of corrugated metal that are separated from each other by an air space when the door is closed to minimize the transfer of heat energy from the oven chamber to the outside surface of the door.

In yet other variations and embodiments of the oven, the door may retract or open sideways and reside when open along the left or right side of the oven box. The door can also be configured to open upwardly and be located above the oven box when in the open position. Further, the door can comprise two sections each which open and close from an opposite side as the other and meet together when the door is closed presumably in front of the oven chamber opening. The number of segments utilized is also variable wherein more segments would permit the door to negotiate a tighter radius during opening and closing and wherein less segments would require a greater radius but the use of a lower number of segment interfaces might make the door more efficient thermally.

The construction of the door segments can also vary substantially. For instance, pieces comprising other metals made from various manufacturing techniques can be used in place of the pieces fabricated from sheet steel as described herein above. The front sections may be made of a high temperature plastic in other variations. Different air path configurations can be utilized as well, or in other embodiments the air path chamber can be eliminated altogether. The manner in which the segments are joined together can vary significantly and substantially as would be obvious to one or ordinary skill in the art given the benefit of this disclosure. In some variations, one or a plurality of electric fan(s) can be provided underneath the bottom insulated door segment to actively blow air through the door's air path to more effectively cool the door. Alternatively a "built-in-to-the-wall" duct and draft fan could be used to draw cool room air into the air chase of the door segments.

The motor and its associated linkage comprising the door actuation mechanism can also vary substantially in other alternative embodiments. For instance, the tracks can be located or formed in the door segments and the corresponding wheels can be attached to the vertical frame members. In other variations, the track and wheel guides can be replaced altogether. Further, other mechanisms and different types of linkage can be used in place of the lead screws and associated nuts. For instance, in one alternative embodiment the door can be pulled closed via a cable threaded over the top of the oven chamber and is secured to a motor driven spindle. In yet other embodiments, the motorized system can be done away with completely with the door being opened and closed manually. In a manually closed or motor driven oven door, a latch mechanism may also be provided, as well as a counterbalance spring or mechanism.

It is appreciated that while the retractable and articulating door is described herein with reference to an oven, doors of similar design can be used in various other appliances, such as but not limited to dishwashers, microwaves, washers, dryers, refrigerators and trash compactors.

We claim:

1. An oven comprising:

an oven box having a plurality of closed sides and at least one vertically disposed substantially open side;

a heating implement contained within the oven box;

a flexible oven door, the oven door being adapted to move between open and closed positions, a substantial portion of the oven door being generally horizontally disposed in the open position, and the oven door being generally vertically disposed in a closed position;

an electric motor assembly, the electric motor assembly being coupled with the flexible oven door and adapted to move the oven door between the open and closed positions;

the electronic controller adapted to control the operation of the electric motor assembly;

one or more controls coupled to a electronic controller, the controls adapted to signal the electronic controller to move the oven door between the open and closed positions when activated by a user;

left and right substantially vertically orientated side seals; and a plurality of solenoids, at least one solenoid of the plurality of solenoids coupled to both a left side of the substantially open side and the left seal, and at least one other solenoid coupled to both a right side of the substantially open side and the right seal;

wherein the controller is operationally coupled to the plurality of solenoids and is adapted to cause the solenoids to retract when the oven door is moving between its open and closed positions.

2. The oven of claim 1, wherein the electronic controller is adapted to deactivate the one or more controls when the oven is in a self cleaning cycle and a temperature within the oven box exceeds a predetermined level.

3. The oven of claim 2, wherein the oven does not include a latch mechanism to lock the oven door when the oven is in a self cleaning cycle.

4. The oven of claim 1, further comprising one or more positional sensors, each positional sensor adapted to provide a signal to the electronic controller indicating the position of the oven door.

5. The oven of claim 1, wherein the electric motor assembly further includes one or more load sensors, the load sensors adapted to signal the electronic controller during the operation of the motor that at least one of (i) the oven door is open, (ii) the oven door is closed and (iii) the oven door is being hindered.

6. The oven of claim 1, further comprising (i) at least one oven rack, (ii) an oven rack motor, and (iii) a linkage, the oven rack being operatively coupled with the oven rack motor by the linkage, the oven rack motor and the linkage being adapted to selectively move the rack between an extended position and a retracted position when activated, the oven rack extending at least partially out of the oven box when in the extended position, and the oven rack being substantially contained within the oven box when in the retracted position.

7. The oven of claim 6, wherein the controller operationally coupled to the oven rack and is adapted to automatically move the rack to the extended position after the oven door has moved into an open position.

8. The oven of claim 1, further comprising a remote control, the remote control being adapted to signal the electronic controller when activated to move the oven door between the open and closed positions.

9. The oven of claim 1, wherein in the oven door is substantially contained within a space above or below the oven box when in the open position.

10. An oven comprising:

an oven box having a plurality of closed sides and at least one substantially open side;

a heating implement contained within the oven box;

an oven door, the oven door comprising a plurality of segments pivotally connected to each other, the door being adapted to move between open and closed positions, a substantial portion of the oven door being located in a space adjacent a closed side of the plurality of closed sides when in the open position, and the oven door substantially covering the open side when in the closed position, at least one segment of the plurality of segments comprising (i) an elongated front section, (ii) an elongated back section, and (iii) an intervening seal comprised of a material having low thermoconductivity, wherein the front and rear sections are coupled to form front and rear box structures by way of the intervening seal which extends around the perimeter substantially eliminating direct contact between the front and rear sections; and at least one electric motor, the electric motor being coupled with the oven door and adapted to move the oven door between the open and closed positions when activated.

11. The oven of claim 10, wherein at least one other segment of the plurality of segments comprises (1) top and bottom receivers, and (2) three panes of glass spaced from front to rear between the top and bottom receivers thereby forming front and rear window box structures.

12. The oven of claim 10, wherein a bottom side and a top side of the front box structure of the at least one segment include vents, the vents permitting air to pass through the front box section, the vents of the at least one segment corresponding to similar vents in adjacent pivotally coupled segments of plurality of segments.

13. The oven of claim 10, wherein the rear box structure of the at least one segment is at least partially filled with insulation and the front box structure is substantially hollow.

14. The oven of claim 10, wherein the front and rear sections of the at least one segment are primarily comprised of steel.

15. The oven of claim 10, wherein an exterior surface of a top side of the front box structure includes an elongated arcuate depression extending lengthwise proximate the intersection of the top side with a front side of the front box structure, and an exterior surface of a bottom side of the front box structure includes an elongated cylindrical gasket extending lengthwise proximate the intersection of the top side with a front side of the front box structure.

16. An oven comprising:

an oven box having a plurality of closed sides and at least one substantially open side;

a heating implement contained within the oven box;

an oven door, the oven comprising a plurality of segments pivotally connected to each other, the door being adapted to move between open and closed positions, a substantial portion of the oven door being located in a space adjacent a closed side of the plurality of closed sides when in the open position, and the oven door substantially covering the open side when in the closed position, wherein one segment of a topmost segment of the plurality of segments and a bottommost segment of the plurality of segments is not positioned over the opening when the oven door is in the closed position; and at least one electric motor, the electric motor being coupled with the oven door and adapted to move the oven door between the open and closed positions when activated.

17. The oven of claim 16, wherein the one segment is comprised primarily of a single piece of steel plate.

18. The oven of claim 16, wherein the one segment does not form a box structure.

19. The oven of claim 16, wherein oven further comprises left and right lead screws, one lead screw of the left and right lead screws being coupled to the electric motor, the other of the left and right lead screws being operationally coupled to the one lead screw by way of a chain or a tensioned belt, the left and right lead screw being operationally coupled to the one segment through respective left and right nuts, the left and right nuts being pivotally coupled to respective left and right sides of the one segment.

20. The oven of claim 16, further comprising an electronic controller, the electronic controller adapted to control the operation of the at least one electric motor.

* * * * *